US006953234B2

(12) United States Patent
Jauert

(10) Patent No.: US 6,953,234 B2
(45) Date of Patent: Oct. 11, 2005

(54) METHOD AND ARRANGEMENT FOR REDUCING PRINTER ERRORS DURING PRINTING IN A MAIL PROCESSING DEVICE

(75) Inventor: Joachim Jauert, Berlin (DE)

(73) Assignee: Francotyp-Postalia AG & Co. KG, Birkenwerder (DE)

( * ) Notice: Subject to any disclaimer, the term of this patent is extended or adjusted under 35 U.S.C. 154(b) by 107 days.

(21) Appl. No.: 10/614,443

(22) Filed: Jul. 7, 2003

(65) Prior Publication Data

US 2005/0007407 A1 Jan. 13, 2005

(51) Int. Cl.[7] ..... B41J 29/38
(52) U.S. Cl. ..... 347/14; 347/19
(58) Field of Search ..... 347/2, 4, 9, 14, 347/19, 57–59, 104; 400/578, 596, 708

(56) References Cited

U.S. PATENT DOCUMENTS

| | | | | |
|---|---|---|---|---|
| 5,337,248 A | | 8/1994 | Eckert, Jr. et al. | 700/228 |
| 5,488,687 A | | 1/1996 | Rich | 345/563 |
| 5,710,721 A | | 1/1998 | Rieckhoff et al. | 714/51 |
| 5,912,979 A | | 6/1999 | Gavrilos | 382/101 |
| 6,247,774 B1 | | 6/2001 | Mueller | 347/2 |
| 6,302,514 B1 | * | 10/2001 | Eade et al. | 347/14 |
| 6,467,901 B2 | | 10/2002 | Von Inten | 347/104 |

FOREIGN PATENT DOCUMENTS

| | | | |
|---|---|---|---|
| DE | OS 100 60 454 | 5/2002 | B41J/11/00 |

* cited by examiner

*Primary Examiner*—Juanita D. Stepehens
(74) *Attorney, Agent, or Firm*—Schiff Hardin LLP

(57) ABSTRACT

In a method and arrangement for reducing printer errors while printing on a print medium in a mail processing device a print data controller for pixel data editing while printing with a printhead contains logic for error reduction having a resettable encoder clock counter. Encoder pulses corresponding to the relative motion between the printer and the print medium are generated. Using these pulses, incremental and decremental counting occurs for evaluating a condition with diminished time spacing of neighboring encoder pulses. A direct memory access (DMA) for a data string of binary pixel data ensues for implementing a print cycle for the data string, and a further direct memory access ensues during the print cycle for a next data string. Following the implementation of the direct memory access for the next data string and dependent on the time spacing of the encoder pulses of a number of successive encoder pulses, the print cycle is completely executed as long as the average value of the encoder period does not downwardly transgress the set duration of a print cycle. In the case of a diminished time spacing of the encoder pulses of the number of encoder pulses, the execution of the print cycle for the printout of binary pixel data of a previous data string is prematurely aborted.

12 Claims, 11 Drawing Sheets

| Address primitiv:= P | Address read := C | | | | | | | | | | | | | |
|---|---|---|---|---|---|---|---|---|---|---|---|---|---|---|
| | P = 1 | P = 2 | P = 3 | P = 4 | P = 5 | P = 6 | P = 7 | P = 8 | P = 9 | P = 10 | P = 11 | P = 12 | P = 13 | P = 14 |
| Address Group := A | | | | | | | | | | | | | | |
| 1 | 0 | 509 | 44 | 41 | 88 | 85 | 132 | 129 | 176 | 173 | 220 | 217 | 264 | 261 |
| 2 | 6 | 3 | 50 | 47 | 94 | 91 | 138 | 135 | 182 | 179 | 226 | 223 | 270 | 267 |
| 3 | 12 | 9 | 56 | 53 | 100 | 97 | 144 | 141 | 188 | 185 | 232 | 229 | 276 | 273 |
| 4 | 18 | 15 | 62 | 59 | 106 | 103 | 150 | 147 | 194 | 191 | 238 | 235 | 282 | 279 |
| 5 | 24 | 21 | 68 | 65 | 112 | 109 | 156 | 153 | 200 | 197 | 244 | 241 | 288 | 285 |
| 6 | 30 | 27 | 74 | 71 | 118 | 115 | 162 | 159 | 206 | 203 | 250 | 247 | 294 | 291 |
| 7 | 36 | 33 | 80 | 77 | 124 | 121 | 168 | 165 | 212 | 209 | 256 | 253 | 300 | 297 |
| 8 | 510 | 39 | 42 | 83 | 86 | 127 | 130 | 171 | 174 | 215 | 218 | 259 | 262 | 303 |
| 9 | 4 | 1 | 48 | 45 | 92 | 89 | 136 | 133 | 180 | 177 | 224 | 221 | 268 | 265 |
| 10 | 10 | 7 | 54 | 51 | 98 | 95 | 142 | 139 | 186 | 183 | 230 | 227 | 274 | 271 |
| 11 | 16 | 13 | 60 | 57 | 104 | 101 | 148 | 145 | 192 | 189 | 236 | 233 | 280 | 277 |
| 12 | 22 | 19 | 66 | 63 | 110 | 107 | 154 | 151 | 198 | 195 | 242 | 239 | 286 | 283 |
| 13 | 28 | 25 | 72 | 69 | 116 | 113 | 160 | 157 | 204 | 201 | 248 | 245 | 292 | 289 |
| 14 | 34 | 31 | 78 | 75 | 122 | 119 | 166 | 163 | 210 | 207 | 254 | 251 | 298 | 295 |
| 15 | 508 | 37 | 40 | 81 | 84 | 125 | 128 | 169 | 172 | 213 | 216 | 257 | 260 | 301 |
| 16 | 2 | 511 | 46 | 43 | 90 | 87 | 134 | 131 | 178 | 175 | 222 | 219 | 266 | 263 |
| 17 | 8 | 5 | 52 | 49 | 96 | 93 | 140 | 137 | 184 | 181 | 228 | 225 | 272 | 269 |
| 18 | 14 | 11 | 58 | 55 | 102 | 99 | 146 | 143 | 190 | 187 | 234 | 231 | 278 | 275 |
| 19 | 20 | 17 | 64 | 61 | 108 | 105 | 152 | 149 | 196 | 193 | 240 | 237 | 284 | 281 |
| 20 | 26 | 23 | 70 | 67 | 114 | 111 | 158 | 155 | 202 | 199 | 246 | 243 | 290 | 287 |
| 21 | 32 | 29 | 76 | 73 | 120 | 117 | 164 | 161 | 208 | 205 | 252 | 249 | 296 | 293 |
| 22 | 38 | 35 | 82 | 79 | 126 | 123 | 170 | 167 | 214 | 211 | 258 | 255 | 302 | 299 |

Fig. 12

METHOD AND ARRANGEMENT FOR REDUCING PRINTER ERRORS DURING PRINTING IN A MAIL PROCESSING DEVICE

RELATED APPLICATIONS

The subject matter of the present application is related to the subject matter of co-pending applications entitled "Method for Printing a Print Image Having Regions With Different Print Image Resolution," (now issued as U.S. Pat. No. 6,776,544). "Arrangement for Controlling Printing in a Mail Processing Device" (now issued as U.S. Pat. No. 6,773,194) and "Method for Controlling Printing in a Mail Processing Device" (now issued as U.S. Pat. No. 6,739,245), all filed simultaneously herewith.

BACKGROUND OF THE INVENTION

1. Field of the Invention

The present invention is directed to a method and an arrangement for reducing printer errors during printing in a mail-processing device. The invention is utilized in postage meter machines, addressing machines and other printing mail processing devices.

2. Description of the Prior Art

In the field of digital printing, the variable part of the print image is becoming more extensive and the print resolution is becoming higher. For example, the variable print image part should be flexible for different postal demands and should be modified from imprint to imprint. At the same time, the controller is burdened with other extensive tasks. For relieving the microprocessor control, it has proven advantageous to arrange the pixel data belonging to a print image column in the pixel memory such that variable picture elements can be modified by the microprocessor in the available time. It has also proven advantageous to relieve the microprocessor responsible for the control of the printing mail processing device or system by using a print data controller for the control of the printing. The printing requires a relative movement between a printhead and a print medium, for example a sheet-like article, letter, postcard, package, franking tape, address sticker or label.

U.S. Pat. No. 6,467,901 and German OS 100 32 855 disclose a device for printing on a print medium that is utilized in a mail processing device such as in the postage meter machine ultimail® of Francotyp Postalia AG & Co. KG. The print media, for example letter envelopes, franking tapes or comparable franking material, are transported downstream in the mail stream in a transport direction by a driven transport drum, with a non-driven counter-pressure device pressing the print medium against the transport drum in a direction orthogonal to the transport direction. The two ink cartridges project partially into the transport drum and carry two ink jet printheads that undertake the printing on the moving print medium in non-contacting fashion. Both printheads are arranged orthogonal to the transport direction and orthogonal to the counter-pressure direction with their nozzles close to the edge of the transport drum, whereby the nozzles can generate a complete imprint in one pass of the print medium through the machine. Markings that are distributed around the circumference of the transport drum are applied to the end face of the transport drum close to the circumference. For example, the markings are reflective lines that are detected by a reflection barrier or transmitted light barrier of an encoder and are converted into printing pulses in the ratio 1:1 by the microprocessor of a controller. Gradual, slow fluctuations in the transport speed thus have no influence on a generated print image when the duration of the print cycle is modified.

According to the manufacturer of the printhead, a print cycle should optimally amount to 90% of the time between two positive encoder edges. The time between the encoder edges can be measured, and the duration of the print cycle can be correspondingly set. After being determined, however, the set value for the print cycle duration takes effect with a delay of at least two encoder clocks. Sudden variation in the transport speed can be caused by changes in the letter thickness and mechanical oscillations of the encoder sampling system. The sudden fluctuations in the transport speed, however, have a negative influence on a generated print image, printer errors due to spacings between the encoder pulses that are too small must be expected despite a subsequent adaptation of the print cycle duration to the distances between the encoder edges.

SUMMARY OF THE INVENTION

An object of the present invention is to provide a method and an arrangement for reducing printer errors during printing onto a moving postal item in a mail-processing device, the printer errors being produced by encoder pulses having a time spacing that is too short. A high print quality should be assured by means of an economical solution even under unfavorable conditions.

Encoder pulses are generated according to the relative motion between the printer and a print medium and are supplied to a print data controller, so a print cycle and a period of time with a succession of DMA cycles are started at every encoder pulse edge given correct encoder pulses and the occurrence of printer errors is prevented. The print data controller generates the print data for the parts of each print column from the pixel data and triggers a print cycle for said print column. As a result, the microprocessor is relieved of the control of printing. During the DMA period, binary pixel data of a data string from the pixel memory are communicated to the print data controller, which compiles the pixel data for a print cycle dependent on the connected printhead type. The invention therefore proceeds from the recognition that it would be unfavorable for the evaluation of printed, security-relevant postal data if complete print cycles, i.e. entire print columns, were missing or the pixels belonging to a print column were printed offset over a number of print columns because the encoder pulses lead the print cycles. This can be alleviated by complete print cycles immediately following one another. It has been found that the outage of only a few pixels from individual print columns does not represent a critical impediment for the evaluation of security imprints having a print image resolution of >300 dpi when the omitted pixels are distributed over the column, i.e. do not occur immediately following one another. Assuming that a reduction of the encoder period only occurs from time to time, a print cycle is aborted if a number of successive encoder pulses occur having too short a time spacing, insofar as the encoder period is longer than a time segment with DMA cycles. The subsequent adaptation of the print cycle duration to the spacings of the encoder edges also assures that this case remains merely an intermittently occurring exception.

The method for reducing printer errors during printing in a mail-processing device includes the following steps:

Encoder pulses are generated corresponding to the relative motion between the printer and the print medium.

Incremental and decremental counting are used for evaluating diminished time spacing of neighboring encoder pulses A direct memory access (DMA) for a data string of binary pixel data is implemented in the time segment with DMA cycles.

A print cycle for the data string is implemented, with a further direct memory access (DMA) in another time segment with DMA cycles ensuing during the print cycle for the data string, and, following the implementation of the direct memory access (DMA) for the next data string and dependent on the time spacing of the encoder pulses of a number of successive encoder pulses, the print cycle is completely executed as long as the average value of the encoder period does not downwardly transgress the set duration of a print cycle or, given a reduced time spacing of the encoder pulses of the number of encoder pulses, the execution of the print cycle for the printout of binary pixel data or a previous data string is prematurely aborted.

Via a bus, the print data controller is connected to the microprocessor and to a pixel memory for the communication of the print data, and to an encoder that acquires the motion of the print medium. At least one printhead is connected to the print data controller via a driver circuit in a known way. The print data controller supplies the required data to the driver circuit of an appertaining printhead in a sequence dependent on the printhead type. The print data controller has an evaluation unit with logic for error reduction of printer errors to which encoder pulses are supplied. The print data controller is also a resettable encoder clock counter having a count value within a counting range that is less than or equal to an upper limit value, and which is incremented with every leading edge of an encoder pulse. The count value is decremented with every print cycle start. The counter outputs a digital count value and this count value is evaluated by the evaluation unit as to the upward transgression of a reference value lying within the count range. Every print cycle is completely executed given no transgression of the threshold and a running print cycle is aborted given upward transgression of the reference value under the condition that all direct memory access (DMA cycles) to the pixel memory that prepares the next printer cycle have ended.

The print data controller is composed, for example, of at least one pixel data-editing unit, a DMA controller, an address generator and a printer controller. The pixel data for the current print cycle are stored in alternation in one of two buffer memories of the pixel data-editing unit. The pixel data for the next print cycle are loaded via DMA into a second buffer memory of the pixel data editing unit while the pixel data for the current print cycle are being communicated to the respective driver circuit of the appertaining printhead. To this end, the address generator makes read addresses for pixel data available to the pixel data-editing unit, and the printer controller organizes the serial output of the pixel data to the respective driver circuit in a print cycle dependent on the encoder pulses. The printer controller inventively has a logic for error reduction of printer errors that are caused by encoder pulses having too short a time spacing. This logic contains a resettable encoder clock counter whose count value within a counting range less than the upper limit value is incremented with every leading edge of an encoder pulse. The count value is decremented with every print cycle start. The outputs of this counter are connected to first and second comparators. The first comparator prevents a decrementation when the zero count value is reached, and the second comparator checks the reaching of the upper limit value. At its output, the encoder clock counter supplies the aforementioned count value and is in operational communication with the address generator. The address generator aborts the running print cycle when all pixel data for the next print cycle were already loaded via DMA into the buffer memory of the pixel data editing unit and the count value of the encoder clock counter lying in the count range has exceeded a predefined rated value.

DESCRIPTION OF THE DRAWINGS

FIG. 12 is a table for the address generation in accordance with the invention.

DESCRIPTION OF THE PREFERRED EMBODIMENTS

Figure 1A:
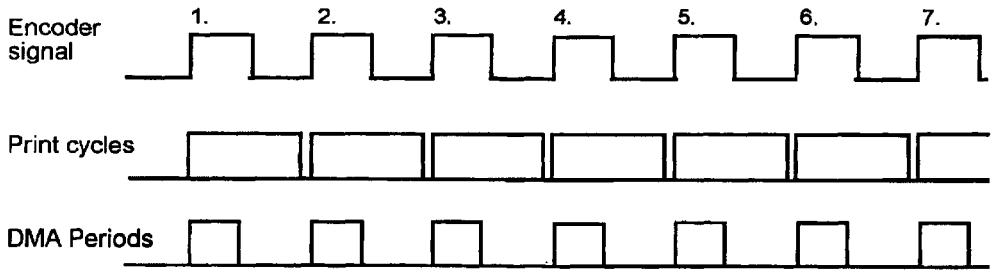
FIG. 1*a* is a pulse/time diagram for correct encoder pulses without an error reduction.

FIG. 1*a* shows a pulse/time diagram for correct encoder pulses without error reduction. At the appearance of every encoder pulse edge, a print cycle and a DMA period with DMA cycles are started when a preceding print cycle has been ended. This is the case given correct encoder pulses.

When printing in a mail processing device, for example a postage meter machine, a piece of mail is moved under or, respectively, along at least one printhead in the transport direction. The print image is generated from columns in a perpendicular arrangement relative to the transport direction, with each printhead printing an allocated part of the same column offset in time. The time offset in the drive of the two printheads for the purpose of printing the same column results from the distance between the two printheads in transport direction and from the transport speed of the print medium in transport direction. Since the two printheads are arranged offset relative to one another in transport direction and each printhead has at least 300 nozzles available to it that are arranged in two nozzle rows spaced apart in the transport direction, pixels at every point in time are printed in four print columns spaced from one another, with an isochronic drive of both printheads. The drive of all 300 nozzles of each printhead ensues within a print cycle wherein 22 groups having 14 pixel data each are successively transmitted to the printhead and are printed.

The letter motion is detected by an encoder. A print cycle is started after every positive edge of the encoder signal insofar as the print cycle triggered by the preceding edge has ended (FIG. 1*a*). This, however, is not the case if a sequence of encoder pulses occurs having too short a time spacing, due to too short a pulse width or pulse pause (FIG. 1*b*).

Figure 1B:
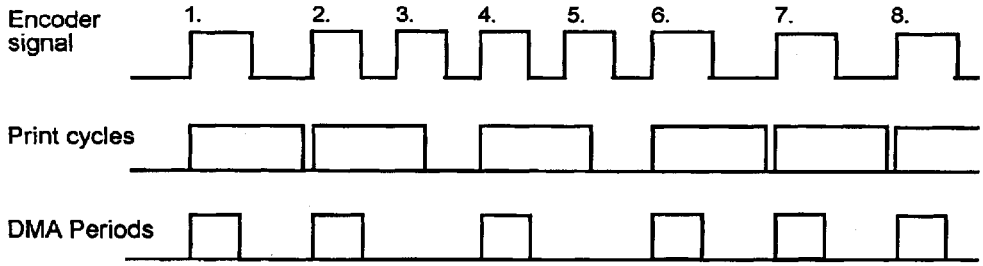
FIG. 1*b* is pulse/time diagram for encoder pulses, in which the encoder pulses occur with too small a time spacing, and without error reduction.

FIG. 1*b* shows a pulse/time diagram for encoder pulses, whereby the third through sixth encoder pulses occur with too short a time spacing. Every encoder pulse thus does not trigger a print cycle. This results in some encoder pulses, particularly the third and fifth encoder pulse, not triggering a print cycle and not triggering a DMA period (time segment with DMA cycles) since the time between the second through sixth encoder pulses is too short. There are different causes for this. The encoder disk employed can exhibit an error of up to 10%. Moreover, additional errors such as, for example, a sudden change of the transport speed, which must be expected due to changes in the letter thickness, jolts and mechanical oscillations between encoder disk and the encoder sampling system (reader). Despite an adaptation of the print cycle duration to the spacings between the encoder edges, one must expect therefore that print errors will occur due to spacings between the encoder pulses that are too short if no measures for error reduction are provided.

Figure 1C:
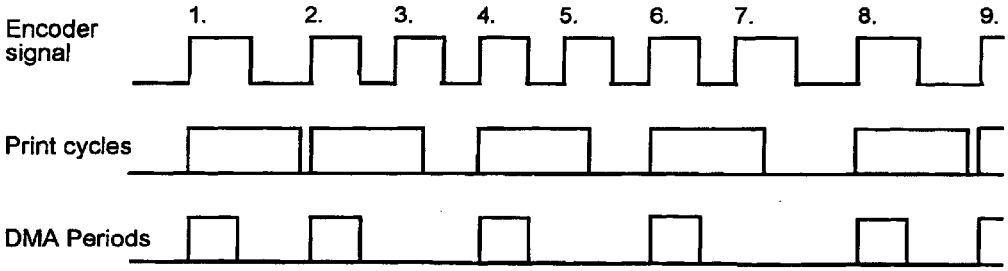
FIG. 1*c* is a pulse/time diagram for encoder pulses without error reduction, in which the encoder pulses occur with too small a time spacing over a longer time segment.

FIG. 1*c* shows a pulse/time diagram for encoder pulses without error reduction, wherein the $2^{nd}$ through $7^{th}$ encoder pulses exhibit too short a time spacing due to a pulse width or a pulse pause that is too short, so that only every other print cycle and time segment with DMA cycles is triggered over a longer time segment. Print image errors can be very disruptive in printing, in particular, 2D bar codes because the authenticity of a franking imprint is to be ascertained therewith.

In the case of encoder pulses with too short a time spacing, only every other encoder pulse triggers a print cycle, i.e. the fourth and sixth encoder pulse in FIG. 1*b* and the fourth, sixth and eighth encoder pulse in FIG. 1*c*. As a result, the spacing between the printed dots in the transport direction becomes about twice the intended spacing. The pixels belonging to one print column also are printed offset over a number of print columns. The print quality deteriorates at approximately the same degree as the degree that the encoder pulses appear with too short a time spacing.

Figure 1D:
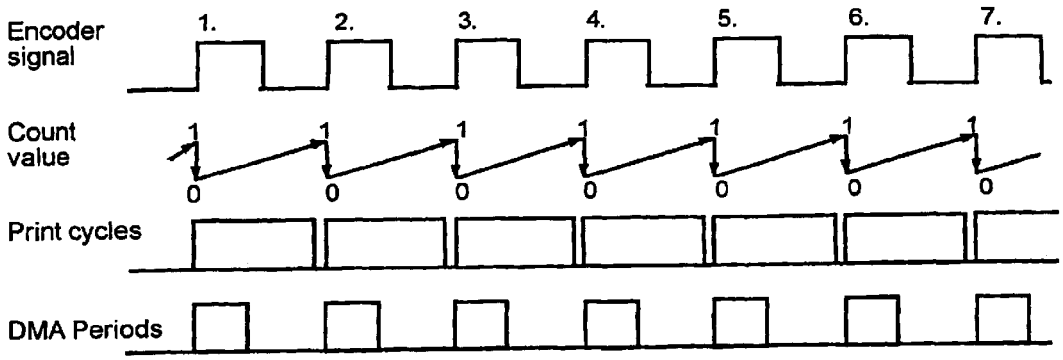
FIG. 1*d* is a pulse/time diagram for correct encoder pulses with error reduction.

FIG. 1*d* shows a pulse/time diagram for correct encoder pulses with error reduction. The time between the encoder edges is determined by the microprocessor, which then sets the print cycle duration according to the particulars of the printhead manufacturer, this taking effect with a delay of at least two encoder clocks. According to the printhead manufacturer, a print cycle should optimally last 90% of the time between two positive encoder edges. Together with the aforementioned regulation of the print cycle duration, which takes effect for encoder pulses having a large time spacing, an encoder clock counter is employed in accordance with the invention to detect encoder pulses having too short a time spacing. The encoder clock counter serves for error reduction. It is reset to the value "zero" at the beginning of every print cycle and is incremented at every encoder pulse, i.e. set to the value "one." The encoder clock counter is decremented, i.e. set to the value "zero", after the start of the DMA controller and of the address generator, the latter triggers the print cycle for the pixel data of a data string.

Figure 1E:
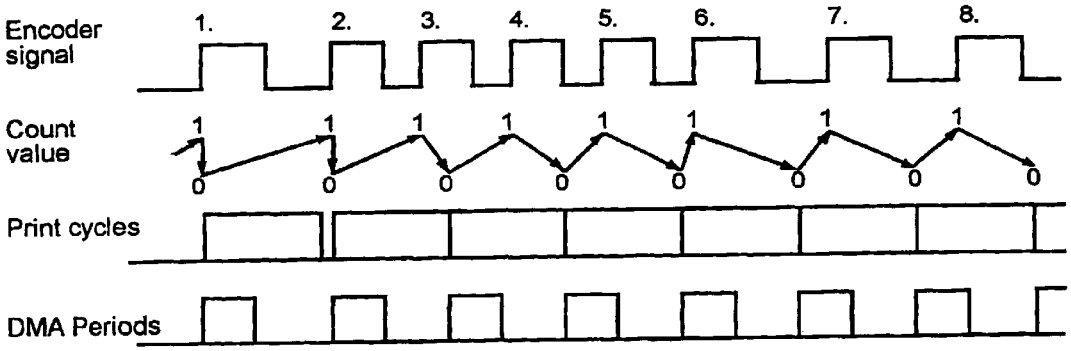
FIG. 1*e* is a pulse/time diagram for encoder pulses with too small a time spacing and with error reduction.

FIG. 1*e* shows a pulse/time diagram for encoder pulses with too short a time spacing and with error reduction. The time spacing between the first two encoder pulses is longer than a print cycle. Beginning with the second through sixth encoder pulse, however, the time spacing between neighboring encoder pulses is clearly shorter than a print cycle. After the sixth encoder pulse, the time spacing between neighboring encoder pulses is again longer and longer than a print cycle. In accordance with the invention, dependent on the reduced time spacing from a number of encoder pulses, the spacing of the print cycles from one another is reduced until the following print cycle for printing out binary pixel data of a following data string follows immediately after a completely executed print cycle for printing out binary pixel data of a previous data string, whereby the reduction ensues to the extent that the encoder pulses lead the print cycles.

Figure 1F:
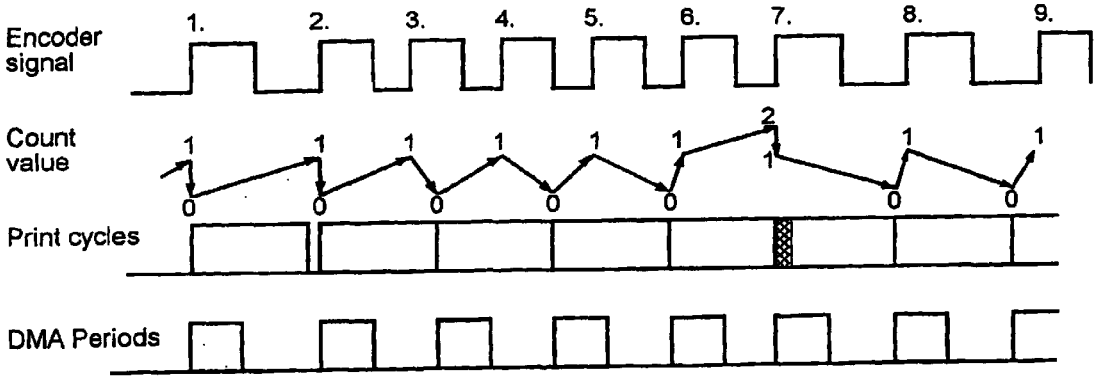
FIG. 1*f* is pulse/time diagram for encoder pulses with error reduction, in which the encoder pulses occur with too small a time spacing over a longer time segment.

FIG. 1*f* shows a pulse/time diagram for encoder pulses with error reduction, wherein the encoder pulses exhibit to short a pulse width and/or pulse pause over a longer time segment. In FIG. 1*f*, a count value 2 that exceeds a reference value Z=1 results in at the seventh encoder pulse, the ongoing print cycle being prematurely aborted by the region shown hatched and a new print cycle begins.

Figure 2:
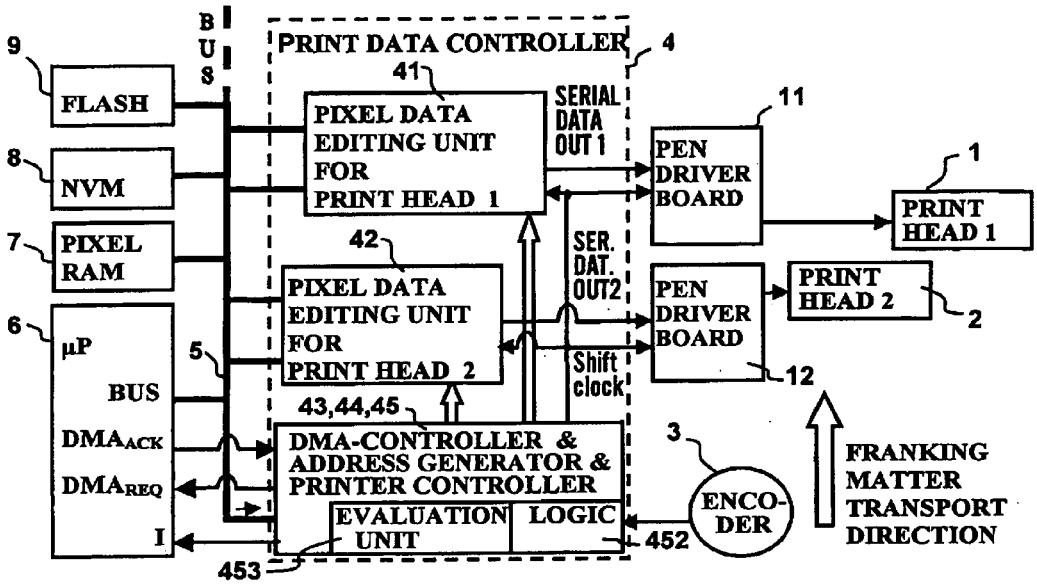
FIG. 2 is a block circuit diagram for pixel data editing by a print data controller.

FIG. 2 shows the block circuit diagram of a preferred circuit arrangement for the pixel data editing by a print data controller. First and second printheads 1 and 2 are respectively connected via driver units (pen driver board) 11 and 12 to a print data controller 4 that, given a direct memory access, accepts 16-bit binary print image data in parallel from a bus 5 at its input side, and outputs serial binary print image data to the driver units 11 and 12 at its output side. Via the bus 5, at least a microprocessor 6, a pixel memory 7, a non-volatile memory 8 and a read-only memory are connected in terms of address, data and control. An encoder 3 is connected to the print data controller 4 in order to trigger the intermediate storing of the binary pixel data and the printing of the print image columns, each printhead 1 and 2 being operated with a maximum clock frequency of 6.5 KHz. An ink jet printer that is postally secured for a franking imprint and can be driven via an appertaining driver unit (pen driver board) and that is arranged in an ink cartridge of the type HP 51645A of Hewlett Packard is disclosed in greater detail in European Patent Application EP 1 176 016. The print data controller 4 has a first and second pixel data-editing units 41 and 42 and the appertaining controls 43, 44 and 45. A printer controller 45 is connected to a DMA controller 43 and to an address generator 44 and the address generator 44 is connected in terms of control to the pixel data-editing unit 41, 42. The printer controller 45 is directly connected to the microprocessor 6 via the bus 5 and via a control line for an interrupt signal I. The DMA controller is connected to the microprocessor 6 via a control line for DMA control signals $DMA_{ACK}$, $DMA_{REQ}$.

Figure 3:
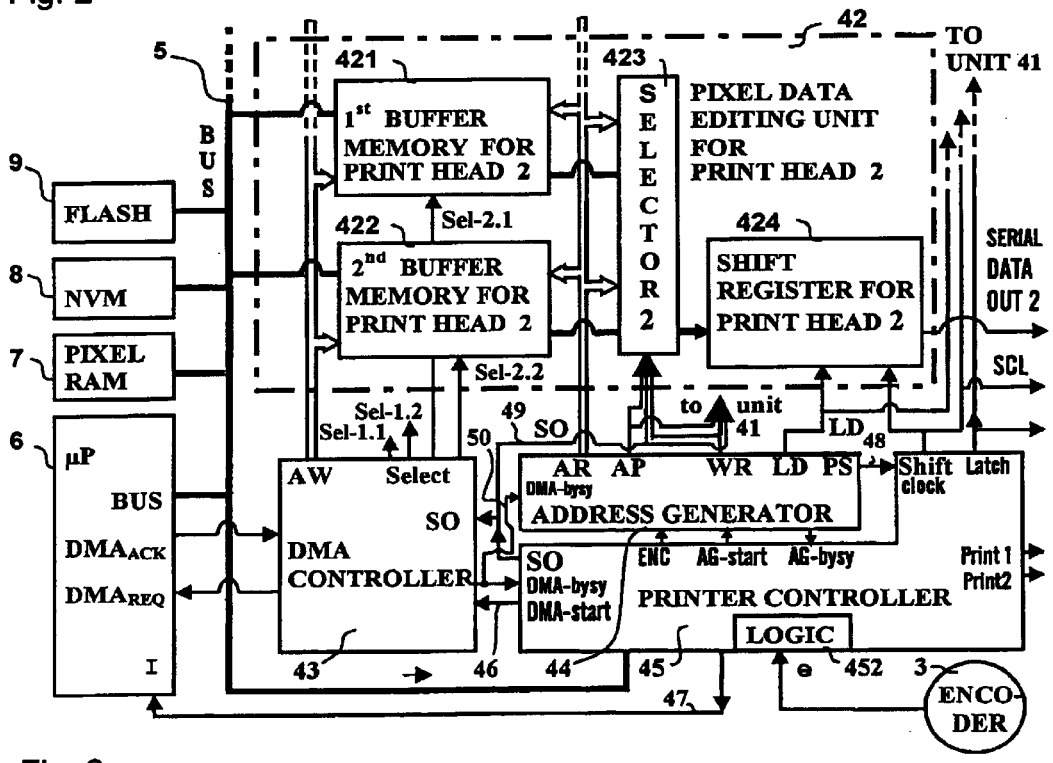
FIG. 3 is an excerpt from the circuit arrangement according to FIG. 2 with pixel data editing unit for the second printhead.

FIG. 3 shows an excerpt from the circuit arrangement according to FIG. 2 with a pixel data-editing unit 42 for the second printhead, with a DMA controller 43 for a direct memory access (DMA) as well as with the circuits of an address generator 44 and of a printer controller 45 arranged in a circuit block. The encoder 3 is connected to the printer controller 45. The latter is directly connected to the DMA controller 43 via control lines for first DMA control signals (DMA start and DMA busy), and the DMA controller 43 is supplied with the DMA start signal by the printer controller 45, and the DMA controller 43 outputs the DMA busy signal having the value "zero" to the printer controller 45 in order to indicate that the direct memory access is ensuing and the DMA cycles have ended. The DMA controller 43 is also connected to the address generator 44 via a control line 50 for the DMA-busy signal.

The printer controller 45 is connected to the microprocessor 6 via the bus 5 and via a control for an interrupt signal I, and is connected to the address generator 44 via a control line for supplying an address generator start signal, and also is connected to the DMA controller 43 via a control line for a switchover signal SO. At least the microprocessor 6, the pixel memory 7, the non-volatile memory 8 and the read-only memory 9 are connected via the bus 5 in terms of address, data and control. The printer controller 45 generates a switchover signal SO in order to drive the pixel data editing unit 42. As a result, the pixel data of the first or the second of the two buffer memories 412 and 422 are selected for a transmission to the driver unit 12. As a result thereof, the binary pixel data of a further data string can be supplied by groups to the driver unit 12. The printer controller 45 supplies the switchover signal SO to the DMA controller 43. The DMA controller 43 generates selection signals Sel_2.1, Sel_2.2 dependent on the switch status of the switchover signal SO in order to intermediately store the binary pixel data in the first buffer memory 421 or the second buffer memory 422. Given a transmission of pixel data from the one of the two buffer memories 421 or 422 to the driver unit 12, the other buffer memory is successively selected by the selection signals for the intermediate storage of a data string. The binary pixel data are made available in the DMA periods, to the pixel data-editing unit 42 by data strings.

The DMA controller 43 emits the DMA busy signal having the value "zero" as an output to the printer controller 45 in order to signal that all direct memory accesses have ensued, i.e. that the period with DMA cycles has ended. The printer controller 45 is connected to the address generator 44 via at least one control line for supplying a start signal (AG start). The address generator 44 generates read addresses and forms an address read signal AR. When a number of address read signals AR for an address group A has been generated, the address generator 44 outputs a print start signal PS to the printer controller 45 via control line 48.

After the transmission of a $22^{nd}$ data group, all of the 300 binary pixel data that a half-inch ink jet printhead requires for printing per print cycle have been communicated.

The pixel data-editing unit for the second printhead 2 is constructed in an identical way.

The printer controller 45 is connected to the microprocessor 6 via a control line 47 for an interrupt signal I and via the bus 5. At least the microprocessor 6, the pixel memory 7, the non-volatile memory 8 and the read-only memory 9 are connected via the bus 5 in terms of address, data and control. The printer controller 45 generates outputs a switchover signal SO and is connected to the DMA controller 43 via a control line and to the pixel data-editing unit 42. The latter is driven in order to select one of the buffer memories 412, 422 via the switchover signal SO for a transmission of pixel data to the driver unit 12. As a result thereof, the binary pixel data of a data string that has already been stored can be supplied by groups to the driver unit 12. The switchover signal SO is supplied to the DMA controller 43 in order to select the other of the buffer memories 412 and 422 for a loading of pixel data. The DMA controller 43 generates and outputs selection signals Sel_2.1, Sel_2.2 dependent on the switch status of the switchover signal SO in order to intermediately store the binary pixel data respectively in the first or the second of the two buffer memories 421 or 422. Given a transmission of pixel data from one of the two buffer memories to the driver unit 12, the other buffer memory is selected by the selection signals for the intermediate storage of a data string.

The two pixel data-editing units are connected at their input sides to the bus 5, but only to the less significant 16 bits of the data bus. As used herein, the terms "data word" or "by words" in the following exemplary embodiments mean a 16-bit data word unless the data word width is expressly otherwise indicated. The pixel data for a ½-inch printhead require only half the space (maximum of 320 bits from each data string) in the pixel memory 7 from which these pixel data are made available to the pixel data-editing unit 42. A data string for both printheads consequently requires that an intermediate storage of 20*16-bit data words be undertaken twice, for example into the first buffer memory. For successive data strings, the first and second buffer memories 421 and 422 are selected in alternation by the selection signals Sel-2.1 and Sel-2.2.

The DMA controller 43 is connected in terms of control to the microprocessor 6 and to the buffer memories 421 and 422. The DMA controller 43 generates address write signals AW that, given an access onto the binary pixel data stored in the pixel memory 7, allow the data to be written into the buffer memories 421, 422 of the pixel data editing unit 42. For addressing by words, the DMA controller 43 supplies a 5-bit address write signal AW. The signal AW is at a separate address input of the first and second buffer memories 421 and 422 for pixel data for the second printhead. The DMA controller 43 supplies a first selection signal Sel_2.1 for pixel data for the second printhead and this is at a separate control input of the first buffer memory 421 for pixel data for the second printhead. The DMA controller 43 supplies a second selection signal Sel_2.2 for pixel data for the second printhead and this is at a separate control input of the second buffer memory 421 for pixel data for the second printhead.

The address generator 44 generates address signals AR, AP and control signals WR, LD, and the address signals AR, AP and the control signals WR, LD are supplied to the pixel data editing unit 41, 42 for the selection of the intermediately stored pixel data and their grouping in a predefined sequence.

Each pixel data editing unit has two buffer memories, a selector for the selection of the binary pixel data and a shift register for the parallel-to-serial conversion of the binary pixel data offered in a new sequence. The address generator 44 supplies the generated address read signals AR to the buffer memories and to the selector of the pixel data-editing unit. The primitive address signals AP and the write control signal WR are supplied to the selector and a load signal LD is supplied to the shift register. Moreover, the printer controller 45 supplies the switchover signal SO to the selector 423. The address generator 44 supplies an address read signal AR for the selection of the data word with the pixel data that are intended for the second printhead. For addressing by words, the more-significant bits of the address read signal AR are at a separate address inputs of the first and second buffer memories 421 and 422. The four less-significant bits of the address read signal AR are at an address input of a second selector 423 and allow an addressing within the 16-bit wide data word. The parallel data outputs of the first and second buffer memories 421 and 422 for pixel data for the second printhead are at a first and second inputs of the selector 423 that, controlled by the address generator 44, supplies a 14-bit parallel data signal at its output to the parallel data input of a shift register 424 for pixel data for the second printhead. The shift register 424 is controlled by a shift clock signal SCL of the printer controller 45 and outputs a serial data output signal SERIAL DATA OUT 2. For the control of the selector 423, the address generator 44 also outputs a primitive address AP and a write signal WR. The address generator 44 outputs a load signal LD to the shift register 424. The printer controller 45 outputs signals Latch and Print2 for the control of the en driver board 12 and is connected to the DMA controller 43 via at least two control lines for the control signals DMA start and DMA busy. Via a control line for the output of the signal SO, the printer controller 45 is connected to corresponding control inputs of the DMA controller 43 and the pixel data-editing unit 42.

The printer controller 45 evaluates the address and control signals communicated via the bus 5, in terms of the occurrence of a print command. The printer controller 45 generates at least the signals DMA-start, AG-start and SO, and stores them in registers and is in communication with the DMA controller 43 via control lines for DMA-start, DMA-busy and SO signals. The SO signals are not generated until the reception of a print command and, triggered by the print command, the printer controller 45 emits a first control signal DMA start to the DMA controller 43, whereupon the DMA controller 43 generates a request signal $DMA_{REQ}$ and sends this to the microprocessor 6. The microprocessor has an internal DMA controller (not shown) available to it that, given a direct memory access, applies a specific address to the pixel memory (RAM) 7, whereby enabling a communication by words of binary pixel data to the buffer memory via the bus 5. To that end, the DMA controller 43 supplies an address write signal AW to the buffer memories. Via DMA, the microprocessor 6 can readout, for example, a 16-bit data word with pixel data from the pixel memory 7 and communicate it to the print data control unit. The microprocessor 6 sends an acknowledge signal $DMA_{ACK}$ to the DMA controller 43 in order to synchronize the generation of the address write signal AW in the DMA controller 43 with the DMA cycle of the microprocessor 6.

Per DMA cycle, a 16-bit wide data word with binary pixel data proceeds into a buffer memory. After 20 DMA cycles, each of the four buffer memories can offer a total of 320 bits for further data editing. For achieving a print resolution of 600 dpi, two of the four buffer memories are used for write-in during the DMA cycles. Given write-in and readout of pixel data for the second printhead by words, the two buffer memories 421 and 422 alternate. During the DMA cycles, the DMA controller 43 therefore supplies first and second selection signals Sel_2.1 and Sel_2.2 in alternation for the word-by-word storage of pixel data for the second printhead. For alternating and word-by-word storage of pixel data for the second printhead, for example, the DMA controller 43 supplies a first selection signal Sel_2.1 and an address write signal AW. The number of pixels desired for each print image column requires that a total of 40 data words of 16 bits each be intermediately stored in two of four buffer memories. Circuitry for emitting the second control signal DMA busy and for realizing at least one cycle counter for a predefined number of 16-bit data words is provided in the DMA controller 43.

In the same way (not shown in detail), the binary pixel data for the first printhead are supplied by words via the bus 5 and are at a corresponding data input of the first and second buffer memories 411 and 412 for pixel data for the first printhead. The first pixel data-editing unit 41 (not shown in detail) for the first printhead likewise has first and second buffer memories 411 and 412. Each has an input side connected to the least significant 16 bits of the data bus of the bus 5. The address write signal AW supplied by the DMA controller 43 is at a separate address input of each of the first and second buffer memories 411 and 412 for pixel data for the first printhead. The DMA controller 43 supplies a first selection signal Sel_1.1 for pixel data for the first printhead and applies this to a separate control input of the first buffer memory 411 for pixel data for the first printhead. The DMA controller 43 supplies a second selection signal Sel_1.2 for pixel data for the first printhead and applies this to a separate control input of the second buffer memory 412 for pixel data for the first printhead.

The address read signal AR supplied by the address generator 44 is likewise in turn applied to a separate address input of the first and second buffer memories 411 and 412 for pixel data for the first printhead and to a first selector 413. The parallel data outputs of the first and second buffer memories 411 and 412 for pixel data for the first printhead are connected to first and second inputs of the selector 413. The selector 413, controlled by the address generator 44, supplies a 14-bit parallel signal at its output to the parallel data input of a shift register 414 for pixel data for the first printhead. The shift register 414 is controlled by the shift clock signal SCL of the printer controller 45 and outputs a serial data output signal "serial data out 1". The printer controller 45 outputs a shift clock SCL to the shift register 414 for pixel data for the first printhead as well as signals latch and Print1 for the control of the pen driver board 11. Via a control line for the output of the signal SO, the printer controller 45 is connected to a corresponding control input of the DMA controller 43 and to the pixel data-editing unit 41.

The cycle counter of the DMA controller 43 is a word counter for a predefined number of 16-bit data words that is started by a DMA start signal. The DMA controller is, for example, a component of an application-specific circuit (ASIC), wherein the cycle counter is connected to the aforementioned circuit for the generation and output of address write signals AW, and to a circuit for the generation and output of selection signals. The latter (not shown) includes at least one output means and first and second comparators. The first comparator drives the output means dependent on the SO signal in order—until a first predefined number of 16-bit data words is reached—to emit a selection signal Sel_1.1 or Sel_1.2 intended for the first pixel data editing unit 41 and in order—after the first pre-defined number of 16-bit data words has been reached—to emit a selection signal Sel_2.1 or Sel_2.2 intended for the second pixel data editing unit 42. After a pre-defined number of 40*16-bit data words has been reached, the second comparator generates a DMA busy signal with the value "zero" and is connected to a control line that is connected to the cycle counter in order to end the counting of DMA cycles.

While the pixel data for a data string are being loaded by direct memory access (DMA) into the respective first intermediate memories 411 and 421 and are being intermediately stored therein, the respective second intermediate memories 412 and 422 can be read out. Using the specific address generator 44 and the selectors 413, 423, the binary pixel data are read out from these buffer memories in the sequence required by the printheads, are collected in groups and subsequently serially transmitted to the two printheads by means of shift registers 414, 424. At least one half of a print image column is printed by the first printhead and at least one other half of a print image column is printed by the second printhead.

As a result of this solution, binary pixel data can be stored in the pixel memory in an optimum order that relieves the microprocessor in the modification of the print image. The microprocessor is likewise relieved by the data transmission by DMA.

The logic 542 for detecting encoder pulses for error reduction is a component of the printer controller 45, and the appertaining evaluation unit (not shown) is a component part of the address generator 44. At its output, the logic 542 communicates a digital count value signal ENC that is more than two bits to the address generator 44, which contains a digital comparator.

A data string counter (not shown in detail) is realized in the printer controller 45, each data string containing the aforementioned 40*16-bit data words. After the binary pixel data obtained from a data string have been edited and printed, the data string counter is incremented at the occurrence of the LH-edge of the encoder clock. When a predefined reference value U of data strings has been reached, then the printing of the print image is ended.

The overall print data controller preferably can be realized with an application-specific circuit (ASIC), or by programmable logic such as, for example, Spartan-II 2.5V FPGA of XILINX (www.xilinx.com).

Figure 4:
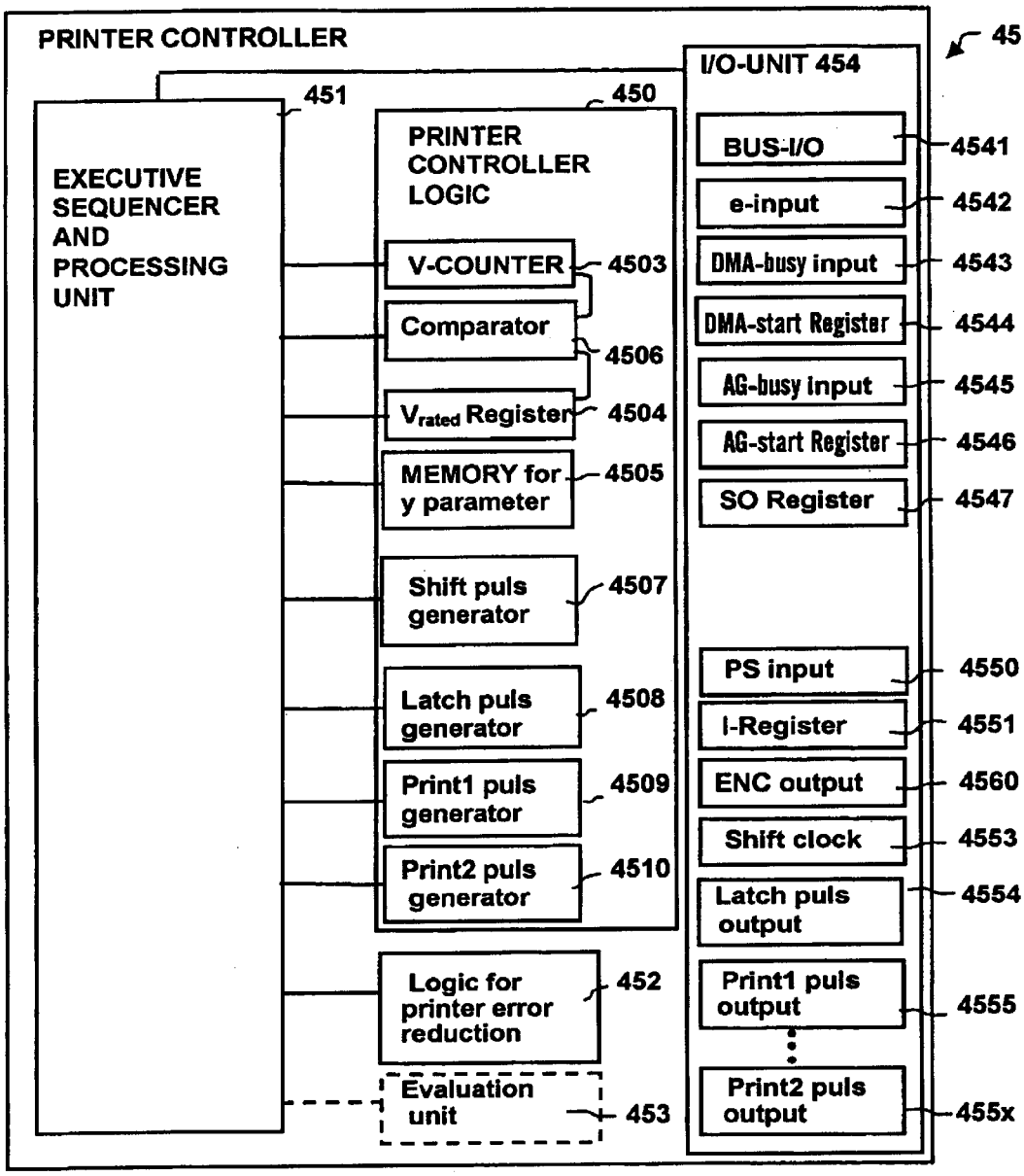
FIG. 4 is a block printer controller in accordance with the invention.

FIG. 4 shows a block circuit diagram of the printer controller 45, which includes a logic 542 for error reduction that shall be explained in greater detail below on the basis of FIG. 6. The logic 542 is operationally connected to an executive sequencer and processing unit 451 to which printer control logic 450 and an input/output unit 454 are connected. The printer control logic 450 includes at least the following blocks: a data string counter 4503 for the data string number V reached during printing, a register 4504 for the data string rated value U, a comparator 4506 for U=V, a memory 4505 for Y and other parameters, a shift pulse generator 4507, a latch pulse generator 4508, a first print pulse generator 4509 and a second print pulse generator 4510.

The first block 451 with the executive sequencer and processing unit contains an encoder filter and an encoder controller that supplies a start signal for the printing of a column, triggers an interrupt request with every leading encoder edge and supports the transmission of the print data within a print column at the correct time. Spikes on the encoder signals are suppressed by the encoder filter. A further counter and further evaluation circuits also are contained in the first block 451. The counter is supplied with a system clock for determining the period duration of encoder pulses. The communication with the microprocessor ensues via the e-input bus-I/O and further registers of the I/O unit 454. In a way that is not shown, a microprocessor-controlled regulation of the print cycle duration effects a setting of the print cycle to a predetermined time duration, preferably approximately 90% of the time between two positive encoder edges.

The input/output unit 454 includes at least the following blocks: a bus input/output unit 4541, an input 4542 for the encoder signal e, an input 4543 for the DMA-busy signal, a register 4544 for the DMA-start signal, an input 4545 for the AG-busy signal, a register 4546 for the AG-start signal, a register 4547 for the switchover signal SO, an input 4550 for the PS signal, an output 4551 for the I signal, an output 4553 for the shift clock signal, an output 4554 for the latch pulse signal, a print1 pulse output 4555 and a print2 output 455*x*. The input/output unit 454 has an ENC output 4560 for the output of the digital count value ENC.

When the evaluation unit 453 (shown with broken lines), for example, is likewise a component of the printer controller—as shown in FIG. 1—then the output signal of the evaluation unit 453 is likewise communicated to the address generator 44, but only as a 1-bit binary abort signal that is offered at the output 4560.

The printer controller 45 can be realized in the embodiment explained above or in an alternative embodiment wherein each printer controller 45—independently of the embodiment—has a data string counter 4503 and is connected to the encoder 3. After every printed data string, the value V of the data string counter is incremented at the appearance of the encoder clock, and the printing of the print image is ended when a prescribed reference value U of the data string counter has been reached.

Figure 5:
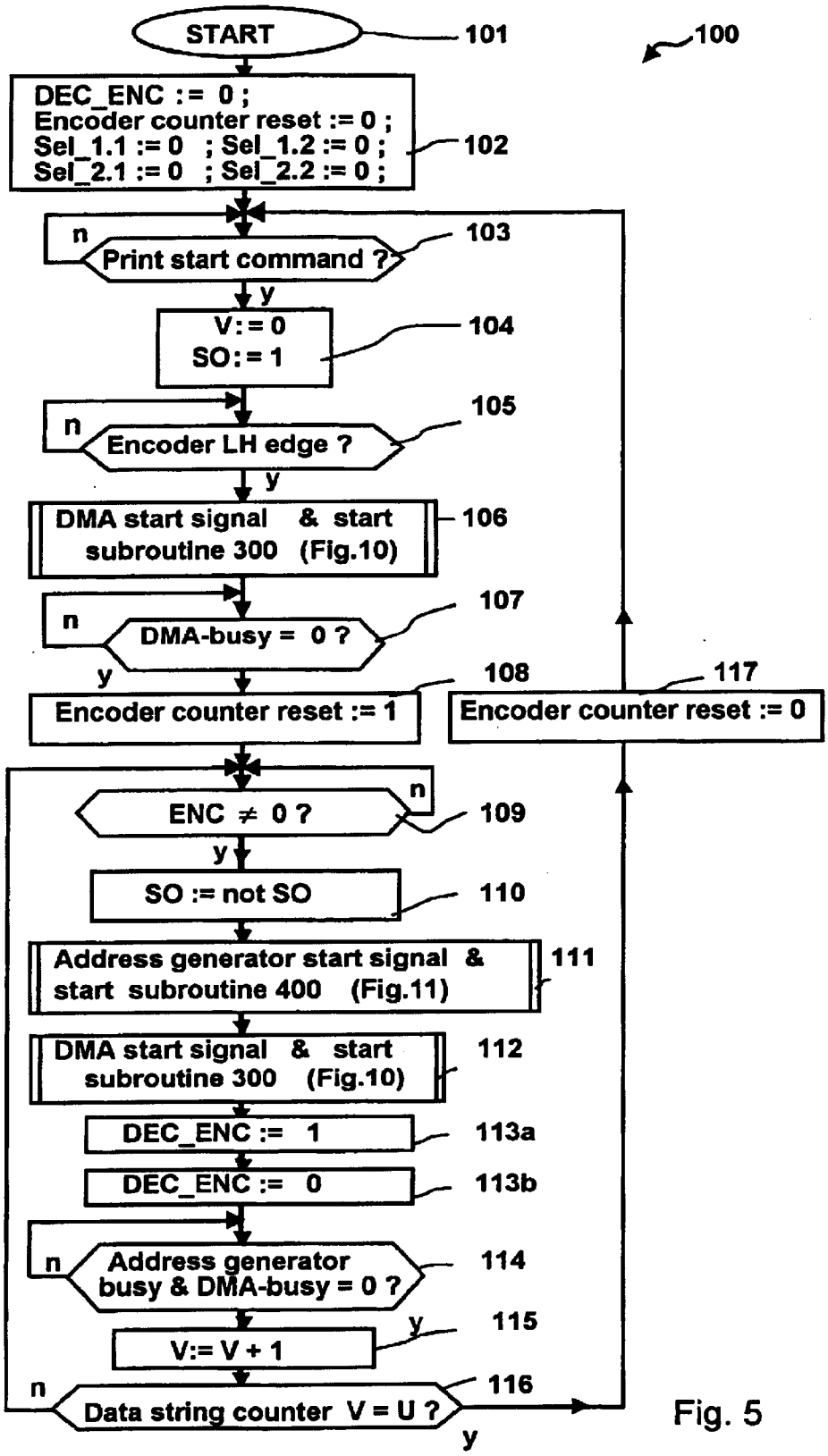
FIG. 5 is a flowchart for the executive sequencer of the printer controller in accordance with the invention.

FIG. 5 shows a flowchart of the executive sequence control of the printer controller. After the activation in step 101, a step 102 is reached, and the decrease signal DEC_ENC, reset signal encoder counter_reset and selection signals Se1_1.1, Sel_1.2, Sel_2.1, Sel_2.2 are set to the value "zero" in the routine 100 of the executive sequence control. In a first interrogation step 103, a data word communicated via a bus is evaluated in view of the occurrence of a command to start printing. If this command has not yet been given, then a branch is made into a waiting list. After the start of printing, a setting of the column count value V to the value "zero" occurs in a step 104. The switchover signal SO is set to the value "one" and output. In a second interrogation step 105, the encoder signal e is evaluated in view of the occurrence of an LH-edge. If this has not yet appeared, then a branch is made into a waiting list. Otherwise, a signal DMA start is output-in a step 106, and a sub-routine 300 is started that sets specific selection signals Sel_1.1, Sel_1.2, Sel_2.1 or Sel_2.2 to the value "one" in order to transfer the binary pixel data into the buffer memories of the pixel data editing units 41 and 42, which shall be explained in detail below on the basis of FIG. 13.

In a third interrogation step 107, the DMA busy signal is evaluated to determine whether it has been set to the value "zero." If this is not yet the case, then a branch is made into a waiting list. When, however, the DMA busy signal has been set to the value "zero", then a signal encoder counter_reset:=1 is generated in step 108. Subsequently, a fourth interrogation step 109 is reached wherein the digital output signal ENC of the encoder clock counter is evaluated in view of a value deviating from the value "zero." A setting of the print cycle to a predetermined time duration between two positive encoder edges ensues for the proper time spacing of the encoder pulses. A spacing between the individual print cycles (FIG. 1*d*) thus arises on the basis of the fourth interrogation step 109. If the digital output signal ENC is not unequal to the value "zero", i.e. equals the value "zero", then a branch is made into a waiting list.

Upon the occurrence of an LH-edge of an encoder signal, the encoder clock counter is incremented, and the digital output signal ENC now becomes unequal to the value "zero." Upon the appearance of an LH edge, thus, a branch is made from the fourth interrogation step 109 to a step 110 wherein the switchover signal SO is logically negated and then output. Subsequently, the address generator is activated in the step 111, and a sub-routine 400 is started that generates read addresses AR intended for the pixel data editing units 41 and 42 and control signals such as the switchover signal SO, the primitive address AP, the write signal WR and a load signal LD. In step 112, a DMA start signal is output and the DMA controller is activated for renewed starting of said sub-routine 300. The two sub-routines 300 and 400 are executed in parallel with one another. The print cycle start is then signaled in a step 113 by generating a short pulse and that the signal DEC_ENC is set to a value "one" in a first sub-step 113*a* and the signal DEC_ENC is set to the value "zero" in a second sub-step 113*b*. In a fifth interrogation step 114, an evaluation is subsequently made as to whether the address generator is finished with its sub-routine 400 and whether the DMA busy signal has been set to the value "zero." If neither has not yet occurred, then a branch is made into a waiting list. If, however, the address generator has finished with its sub-routine 400 and the DMA busy signal has been set to the value "zero", then a step 115 is reached. In step 115, the data string count value is incremented by a value "one" to V:=V+1. In a sixth query step 116, an evaluation is made as to whether the column count number V has reached a limit value U. If this is not yet the case, then a branch is made to the fourth interrogation step 109. Otherwise, a branch is made via a step 117 onto the first query step 103 and the routine begins anew when a print start command is found in the first interrogation step 103. In the step 117, a reset signal encoder counter_reset:=0 is generated and the encoder counter is reset to the value "zero."

In the exemplary embodiment shown in FIG. 4, there is a separate second block 452 that is operationally connected to the first block 451 of the printer controller 45 containing the executive sequencer and processing unit. The block 452 contains the logic for printer error reduction and is a component part of the printer controller 45. The connection includes multiple lines (not shown) for analog and/or digital electrical signals. An encoder signal e, filtered by the first block 451 is serially supplied to the second block 452, which generates a parallel n-bit digital output signal ENC that represents a count value. The connection of the second block 452 to the ENC output of the I/O unit 454 likewise ensues via the first block 451 of the printer controller 45. The block 451 is connected to the I/O unit 454 of the printer controller. After activation, the processing unit of the first block 451 sets the decrease signal DEC_ENC and the reset signal encoder counter_reset to the value "zero." The printer controller 45 contains a third block 450 with the printer controller logic. The logic has a parameter Y stored in the parameter memory 4505 as an upper limit value for the logic for printer error reduction.

Alternatively, a separate second block can be omitted (not shown) when the logic for printer error reduction is a component of the first block 451 of the printer controller 45.

Figure 6:
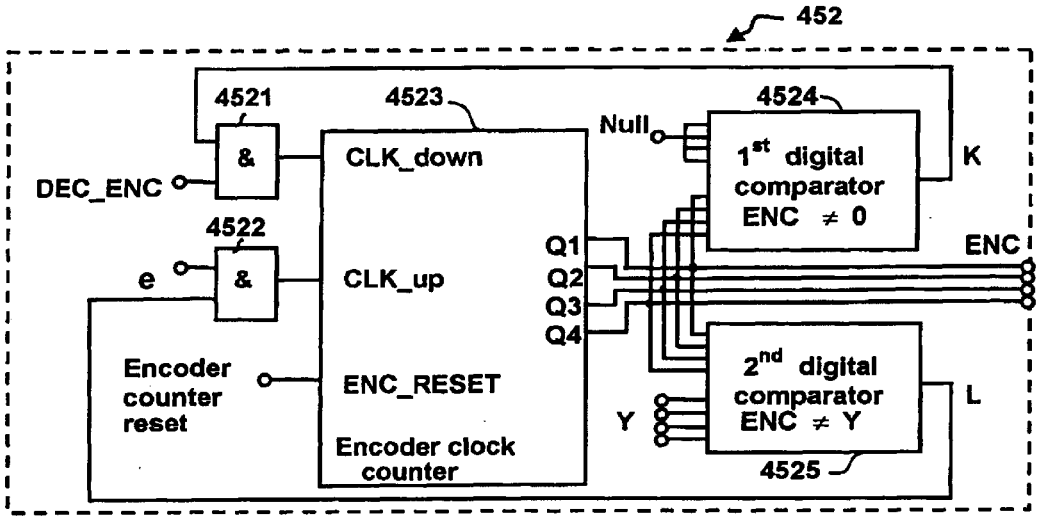
FIG. 6 is a block diagram for logic for the printer error reduction in accordance with the invention.

FIG. 6 shows a block circuit diagram of the logic for printer error reduction. The respective outputs of first and second AND gates 4521, 4522 are connected to the inputs of an encoder clock counter 4523 that has a first input CLK_down, a second input CLK_up and a third input ENC_RESET for the reset signal encoder counter_reset. The decrease signal DEC_ENC is supplied via a first input of the first AND gate 4521. The output K of a first digital comparator 4524 is connected to the second input thereof. In a simple embodiment (not shown), an OR-gate is utilized as a first digital comparator 4524, operating on the digital output signal ENC of the encoder clock counter 4523 and emitting a logic "one" at its output given ENC≠0.

The filtered encoder signal e is serially supplied via a first input of the second AND-gate 4522. The output L of a second digital comparator 4525 is connected to a second input of the AND gate 4522.

The count value is present in digital form at the respective first inputs of the first and second digital comparators 4524, 4525 by respective binary values being output at, for example, the n=4 outputs Q1, Q2, Q3, Q4 of the encoder clock counter 4523. The encoder clock counter 4523 is shown as a 4-bit counter in the exemplary embodiment but is not limited to such an embodiment. Other embodiments of n-bit counters are possible. In the preferred embodiment, the two digital comparators are identically constructed. For example, m exclusive-OR gates have their output sides linked to one another via an OR-gate, with each exclusive-OR gate comparing one place of the n-bit number to a corresponding place of the n-bit comparison number.

An n-bit, digital data signal with the binary value "zero" is present at the second input of the first digital comparator 4524. An n-bit wide, digital data signal having the corresponding binary values for the upper limit value "Y" is present at the second input of the second digital comparator 4525, this upper limit value "Y" being supplied via the first block 451 of the printer controller 45. The signal encoder counter_reset and the DEC_ENC signal are likewise supplied by the first block 451 of the printer controller 45. The first digital comparator 4524 operates in a known way and emits a logic signal, for example TTL. For example, a binary value "one" at the output K signals that the condition ENC≠0 has been met. Consequently, the DEC_ENC signal supplied via a first input of the first AND-gate 4521 is through-connected to the first input CLK_down of the encoder clock counter 4523 in order to decrement the count value. The second digital comparator 4525 output a logic signal having the binary value "one" at the output L when the condition ENC≠Y has been met. The filtered encoder signal e supplied via a first input of the second AND-gate 4522 is then through-connected onto the second input CLK_up of the encoder clock counter 4523 in order to increment the count value. The first or second digital comparator 4524 or 4525 outputs a TTL signal having the value "zero" if the aforementioned, condition is not met. In this case, the AND-gate 4521 or 4522 are inhibited.

Figure 7A:
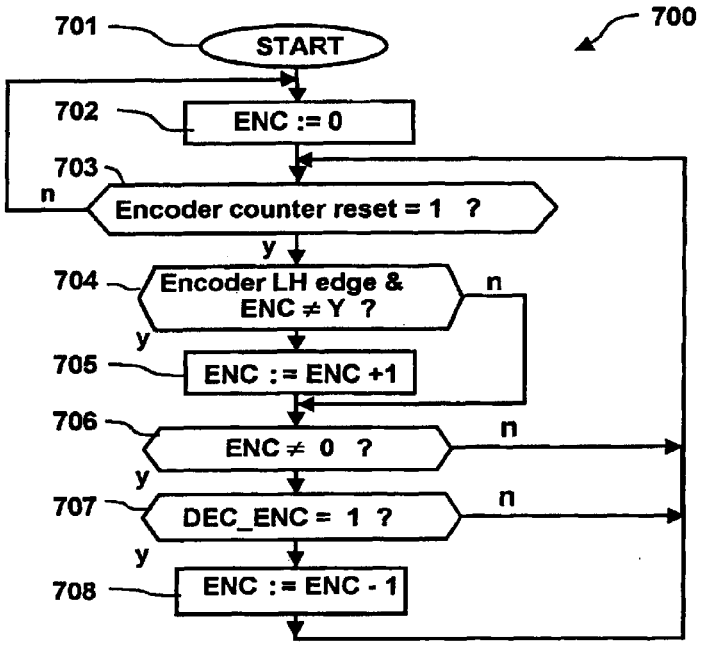
FIG. 7*a* is a flowchart for the printer error reduction in accordance with the invention.

FIG. 7*a* shows a flowchart for the printer error reduction. The routine is started in step 701. After the start, the counter reading is first reset to the value "zero" in step 702. In the following interrogation step 703, constant branching back to the step 702 is made in anticipation of an enable by means of a reset signal encoder counter_reset having the value "one."

After a first DMA cycle, the processing unit of the block 451 (shown in FIG. 4) resets the reset signal encoder counter_reset to the value "one", as can be derived from step 108 of FIG. 5. This reset signal is present at the third input ENC_RESET of the encoder clock counter 4523 shown in FIG. 6. When an encoder counter reset signal having the value "one" is detected in the interrogation step 703, a second interrogation step 704 is reached wherein a determination is made as to whether an encoder LH edge is supplied to the second AND-gate 4522 via a first input while the output side of the second comparator 4525 outputs a value "one", with which the comparator 4525 signals that the condition ENC≠Y has been met.

At its output, the second AND-gate 4522 emits a value "one" to the second input CLK_up of the encoder clock counter, causing the count value to be incremented by the value "one" in the following step 705, so that the count value ENC:=ENC+1 is reached. Subsequently, a branch is made to a third interrogation step 706.

If, however, no encoder LH edge is supplied to the second AND-gate 4522 via a first input and the condition ENC≠ is not met, then a branch is made from the second interrogation step 704 onto the third interrogation step 706.

In the third interrogation step 706, the first comparator 4524 finds that the count value ENC is unequal to the count value "zero." In this case, a branch is made to the fourth interrogation step 707. Otherwise, a branch is made back to the first interrogation step 703. In the fourth interrogation step 707, a check is made to determine whether the DEC_ENC signal supplied via the first input of the first AND-gate has the value "one." In this case, the output side of the first AND-gate 4521 outputs a value "one" onto the first input CLK_down of the encoder clock counter, causing the count value to be decremented by the value "one" in the following step 708, so that the count value ENC:=ENC-1 is reached. Otherwise, a branch is made from the fourth query step 707 back to the first interrogation step 703. Subsequently, a branch is made from the step 708 back to the first interrogation step 703.

Figure 7B:
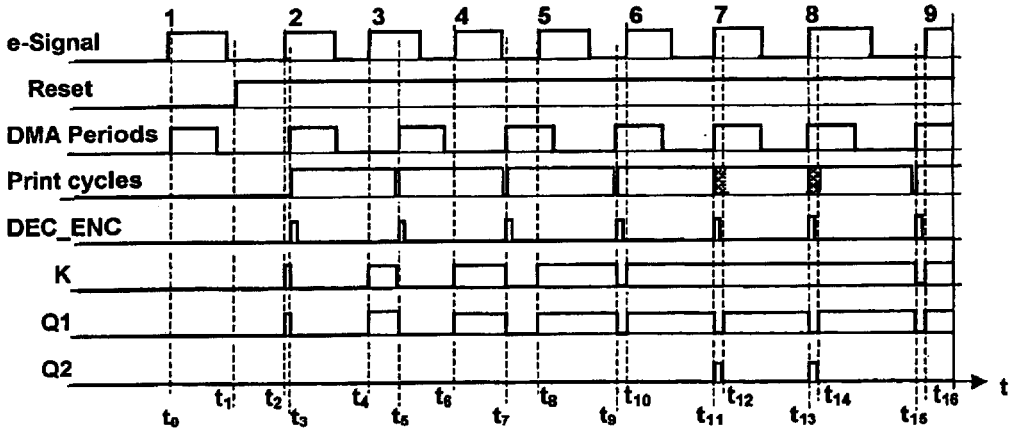
FIG. 7*b* is a pulse/time diagram for printer error reduction in accordance with the invention.

FIG. 7*b* shows a pulse/time diagram for the printer error reduction. After the start, the reset signal encoder counter_reset and the decrease signal DEC_ENC are set to the value "zero" in the routine 100 of the printer controller. A number of encoder pulses occur in too short a time spacing over a longer time segment. In the pulse/time diagram of FIG. 7*b*, however, the time segment is longer than in the pulse/time diagram of FIG. 1*f*.

After a first encoder pulse appears, a first period begins at time $t_0$ for loading the pixel data for the first print cycle into the buffer memories by DMA cycles. At time $t_1$, the encoder clock counter 4523 is enabled by the reset signal encoder counter_reset:=1 set to the value "one" (FIG. 5, step 108). The condition ENC≠Y is met given the count value "zero", so that said encoder clock counter is incremented by the value "one" with every positive encoder edge of the encoder signal e. At time $t_2$, a second encoder pulse appears and the encoder clock counter is incremented and now has the count value "one." The output K of the first comparator 4524 (FIG. 6) then emits the binary value "one" that is adjacent at the input of the first AND-gate 4521. The output Q1 and K remain set to the binary value "one" until time $t_3$. Dependent on the time spacing of neighboring encoder pulses, either the incrementing continues as long as the predefined, upper limit value Y has not been reached, or the count value can be decremented given the occurrence of a print cycle. At time $t_3$, a second period with DMA cycles and a first print cycle for the pixel data of a data string loaded in the preceding, first DMA period with DMA cycles are started. A decrease signal (pulse) DEC_ENC generated by the printer controller 45 is output to the logic 452, which leads to decrementation so that the count value again has the value "zero."

Beginning with time $t_3$, the first-cited buffer memory 411 of the print data controller 4 is read out for printing a data string. At the same time, the pixel data for a second print cycle are loaded by DMA into the other buffer memory 412 of the print data controller 4. A third encoder pulse already appears at time $t_4$ before a third print cycle can be started. The outputs Q1 and K remain set to the binary value "one" up to time $t_5$. At time $t_5$, a second print cycle and a third DMA period are started. The time spacing of the following points in time $t_6$ and $t_7$, $t_8$ and $t_9$ as well as $t_{10}$ and $t_{11}$ increases to such an extent that—at time $t_{11}$—the seventh encoder pulse takes effect before the sixth DMA period. In such a case, the encoder clock counter is longer decremented to the same degree as it is incremented. As a consequence, the count value increases. Despite an ongoing print cycle, the first comparator 4524 of said logic 452 checks whether the counter content is unequal to zero. When this is the case, it waits for a decrease signal DEC_ENC. When a print cycle is started, then the printer controller outputs a decrease signal DEC_ENC. At time $t_{11}$, the encoder clock counter is still incremented before the decrementation. The outputs Q1 and K remain set to the binary value "one" from time $t_{10}$ until time $t_{11}$ and then change to the value "zero." At the same time, the output Q2 changes to the binary value "one", i.e. the counter content has increased to the count value "two" by time $t_{11}$. This counter status lasts only until time $t_{12}$ since a decrease signal DEC_ENC with the value "one" was also output to the encoder clock counter at time $t_{11}$. The output Q2 again changes to the binary value "zero" and the output Q1 again changes to the binary value "one" corresponding to the decremented count value "one." The eighth encoder pulse is output at time $t_{13}$, and conditions comparable to those at time $t_2$ prevail, with the exception that the encoder clock count value now stands at the value "one" before the incrementing. The eighth encoder pulse at time $t_{13}$ also takes effect before the seventh DMA period with DMA cycles. The output Q2 again changes to the binary value "one" and the output Q1 again changes to the binary value "zero" corresponding to the incremented count value "two." This counter status only lasts until time $t_{14}$ since a decrementation signal DEC_ENC having the value "one" was likewise emitted to the encoder clock counter at time $t_{13}$.

After the printing of each pixel group, the address generator 44 checks in the subroutine 400 to determine whether the count value has reached a reference value Z. If this is the case and the data for the next print cycle have been loaded into the buffer memory by DMA, then the ongoing print cycle is aborted. In FIGS. 1*f* and 7*b*, a count value that exceeds the rated value Z=1 resulting in the ongoing print cycle being prematurely aborted by the region shown hatched at the seventh encoder pulse, or at the seventh and eighth encoder pulses and a new print cycle begins.

At time $t_{15}$, the sixth print cycle ends and a seventh print cycle begins. A decrease signal DEC_EBC having the value "one" is therefore output to the encoder clock counter, and the output Q1 again changes to the binary value "zero" corresponding to the decremented count value "zero." This counter status lasts only until time $t_{16}$ since the ninth encoder pulse was output. Incrementation is thus carried out again and the output Q1 again changes to the binary value "one" corresponding to the incremented count value "one." This continues like this until a predetermined number of print cycles has been processed. The count value of the encoder clock counter is decremented with every print cycle start (FIGS. 1*d*, 1*e*, 1*f* and 7*b*). A number of advantages derive as a result of this method. All encoder pulses having too short a time spacing start print cycles insofar as the encoder pulse period duration is longer than the DMA period with DMA cycles. Only slight degradation of the print quality need be expected given a number of successive encoder pulses with very short time spacing. A resulting offset of the pixel data belonging to a printing column in the exemplary embodiment that has been explained is at most equal to the spacing of one printing column. As a result, it is assured that the pixels belonging to any printing column are not printed offset over a number of printing columns. Since only an ongoing print cycle is prematurely aborted, which is shown hatched in FIGS. 1*f* and 7*b*, correspondingly fewer pixels are missing in the print image than in the extreme case when a complete print cycle is missing.

Figure 8:
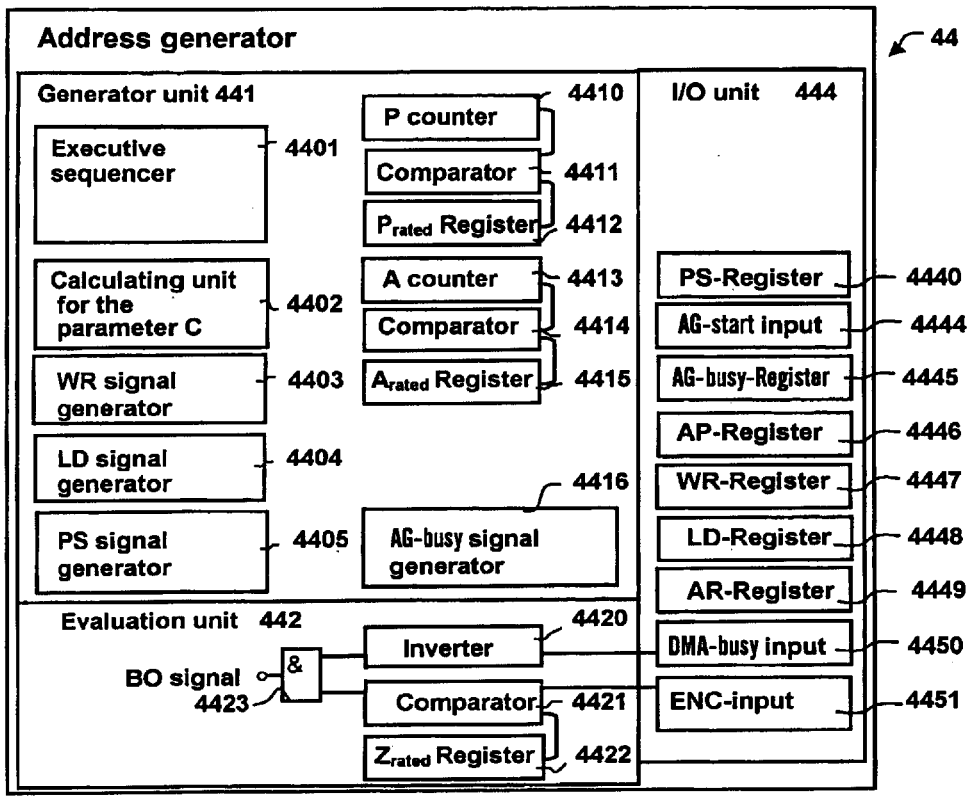
FIG. 8 is a block circuit diagram of an address generator in accordance with the invention.

FIG. 8 shows a block diagram of an embodiment of the address generator 44. The address generator 44 has an input/output logic 444, an evaluation unit 442 and a unit 441 for generating read addresses. The unit 441 has a first counter 4410 for the primitive address and an allocated, first comparator 4411 for the comparison of a count value P of the primitive address to a first reference value that is supplied from a first rated value register 4412. The unit 441 comprises a second counter 4413 for an address group and an allocated, second comparator 4414 for the comparison of a count value A of the address group to a second reference value that is supplied from a second reference value register 4415, and also has an executive sequencer 4401. The sequencer 4401 collaborates with a calculating unit 4402 for the parameter C, a WR signal generator 4403, an LD signal generator 4404, a PS signal generator 4405, the counters 4410 and 4413, the comparators 4411, 4414, 4418, the registers 4412, 4415, 4417 and an AG-busy signal generator 4416.

The evaluation unit 442 has an inverter 4420 for the DMA-busy signal, an AND-gate 4423, a register 4422 for at least one third reference value Z and a third comparator 4421 to which the count value of the encoder clock counter is supplied for comparison to at least a third reference value Z. The respective outputs of the inverter 4420 and the comparator 4421 are connected to inputs of the AND-gate 4423. If only ENC values from "zero" through "two" occur as a rule, then the third reference value is Z=1. The third comparator 4421 can be simply constructed to check that neither ENC values "zero" nor "one" occur. The logic signals at the Q outputs of the encoder clock counter are operated only an OR-gate, and n exclusive-OR gates are linked at the output side via a second OR-gate. Each exclusive-OR gate compares one place of the n-bit number to a corresponding place of the n-bit comparison number of the reference value Z=1, and the OR-gate outputs are operated on by an AND-gate that emits the output signal of the third comparator 4421. The AND-gate 4423 emits an abort signal BO having the value "one" at its output when the negated DMA-busy signal and the output signal of the third comparator 4421 have the value "one."

The input/output logic 444 of the address generator 44 has an input 4450 for the DMA-busy signal, an input 4451 for the ENC signal, an input 4444 for the reception of the address generator start signal and a register 4445 for the address generator busy signal to be sent.

Alternatively, the printer controller can undertake the aforementioned comparison of the ENC signal to the reference value Z in order to generate and abort signal BO as a result of the comparison. The I/O unit 454 of the printer controller 45 then contains a BO output instead of the ENC output 4560. The input/output logic 444 of the address generator 44 then need only contain a BO input instead of the ANC input 4451, to which the abort signal BO is supplied instead of the count value ENC. The control line 50, the DMA-busy input 4450 and the evaluation unit 442 in the address generator 44 are then eliminated. A corresponding evaluation unit 453 is instead realized in the printer controller 45 in order to implement the aforementioned comparison of the ENC signal to the reference value Z and to generate an abort for the print cycle as a result of the comparison, this being supplied to the address generator 44.

The operating mode of the address generator 44 is described in detail below. After a formation of the address read signal AR and after an incrementation of a count value P for the primitive address by the value "one", the comparison in the first comparator 4411 is undertaken, causing the counter 4413 for an address group to be incremented by the value "one" after a number of read addresses is generated, an upward transgression of the first reference value (overflow) of the counter 4410 for the primitive address is triggered, a load signal LD is output and a subroutine for the output is started. A downward transgression of the second reference value in the comparison in the second comparator 4414 triggers a resetting of the count value P of the primitive address to the value "one" and a generation of a following read address that belongs to a further address group, and an ongoing print cycle is prematurely aborted given the occurrence of a predefined condition. The latter is then case when an upward transgression of the third reference value is found in the comparison in the third comparator 4421 and the DMA controller outputs a DMA-busy signal having the value "zero," that indicates the ending of all DMA cycles for accessing to the pixel memory 7 that prepares the next print cycle.

The executive sequencer 4401 is connected to a calculating unit 4402 for the parameter C, a signal generator 4403 for generating a write signal WR, a signal generator 4404 for generating a load signal LD, a further signal generator 4405 for generating a print start signal PS for initiating the printout of the pixel data from a data string, and to the busy signal generator 4416. The input/output logic 444 also has a register 4446 for the output of the primitive address AP, a register 4447 for the write signal WR, a register 4448 for the load signal LD, a register 4449 for the output of the address read signal AR and a register 4440 for the output of the print start signal PS.

Figure 9:
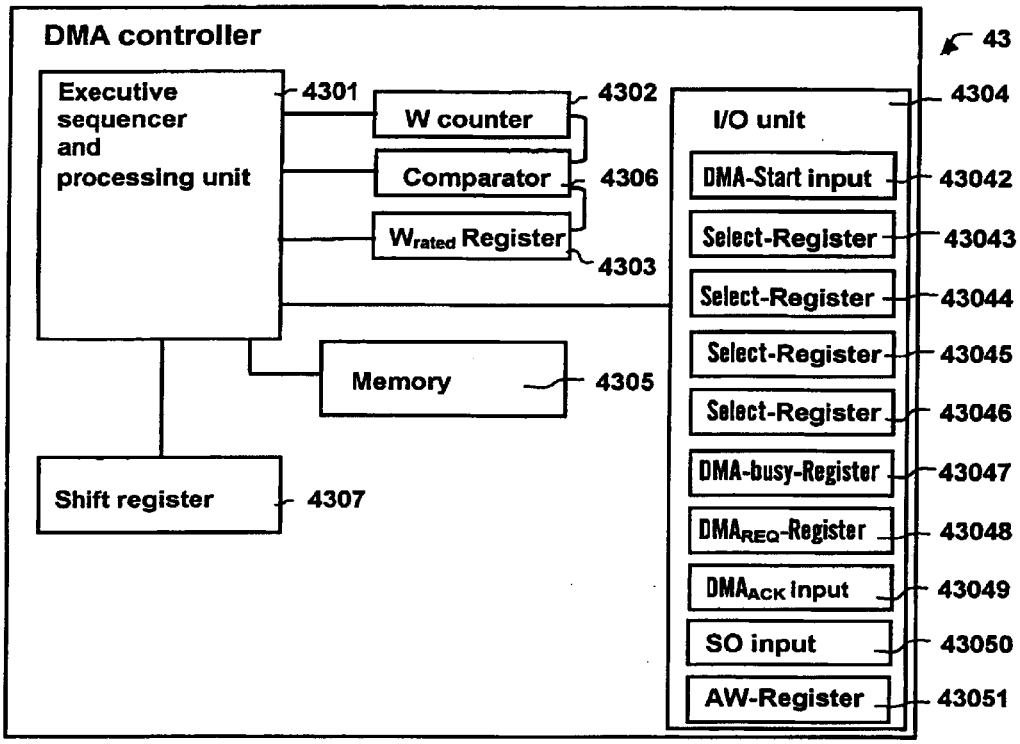
FIG. 9 is a block circuit diagram of a DMA controller in accordance with the invention.

FIG. 9 shows a block circuit diagram of a DMA controller. The DMA controller 43 has at least one executive sequencer 4301, a word counter 4302, a reference value register 4303, an input/output logic 4304, a memory 4305, a comparator 4306 and a shift register 4307 that are interconnected to one another in order to implement DMA cycles. A further processing unit to which the aforementioned blocks 4302 through 4307 are connected in terms of circuitry can be integrated into the executive sequencer 4301. The aforementioned switching of the number of data words can ensue with a shift register, since a place shift of binary numbers corresponds to a division by the number two and a further place shift corresponds to a division by the divisor four derived from the number two. In order to assure the signal flow within the print data controller 4 and between the DMA controller 43 and the print data controller 6, the input/output logic 4304 has at least an input 43041 for the communicated compression factor $F_D$, an input for the received DMA start signal and registers 43043 through 43046 for the select signals to be transmitted, a register 43047 for the DMA-busy signal to be transmitted, a register 43048 for the request signal $DMA_{REQ}$ to be transmitted, an input 43049 for the received acknowledge signal $DMA_{ACK}$, an input 43050 for the switchover signal (SO) and register 43051 for the address write signal AW.

Figure 10:
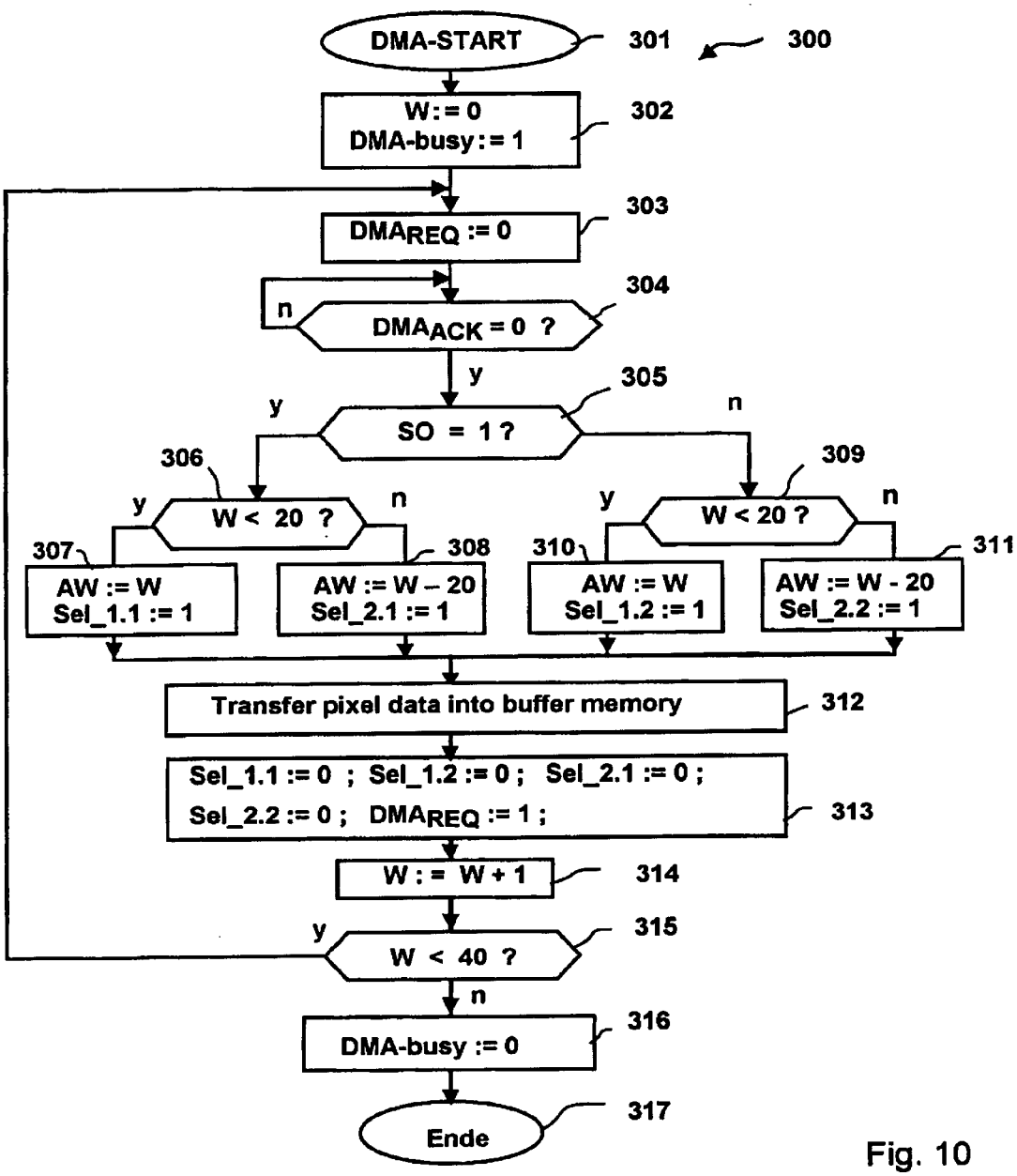
FIG. 10 is a flowchart for the DMA controller in accordance with the invention.

FIG. 10 shows a flowchart for the DMA controller. Such a sub-routine is called when the printer controller 45 outputs a DMA start signal to the DMA controller 43 (step 301). A word count value W is set the value 'zero' in a step 302 of the sub-routine 300. A DMA busy signal is set to the value 'one' and communicated to the printer controller 45. A DMA request signal $DMA_{REQ}$ having a value 'zero' is communicated to the microprocessor 6 in a further step 303 of the sub-routine 300. Said microprocessor 6 communicates an acknowledge signal DMAACK to the DMA controller 43. In a first interrogation step 304 of the sub-routine 300, a branch is made into a waiting list given non-reception of the acknowledge signal DMAACK with a value 'zero'. Upon reception of the acknowledge signal DMAACK with a value 'zero', a further branch is made from the first interrogation step 304 of the sub-routine 300 to a second interrogation step 305, whereby the status of the switchover signal SO is determined. When the switchover signal SO has the status equal to 'one', then a branch is made to a third interrogation step 306. Otherwise, the switchover signal SO has the status equal to 'zero', and a branch is made to a fourth interrogation step 309. A check is carried out in the third interrogation step 306 as to whether the word counter exhibits a value W of less than twenty. In this case (W<20), a branch is made to a step 307. In step 307, the first selection signal for the first printhead Sel_1.1 is switched to the value 'one', and the address write signal AW receives the current value W of the word counter. In the following step 312, the pixel data are transferred into the buffer memories of the pixel data-editing units 41, 42. In step 313, subsequently, all selection signals are switched to the value 'zero', and a DMA request signal DMAREQ having a value 'one' is communicated to the microprocessor 6.

In step 314, the word count value W is incremented with the value 'one'. A check is made in a subsequent interrogation step 315 to determine whether the word counter exhibits a value W less than forty, In this case wherein the word counter exhibits a value W<40, a branch is made back to a step 308. Otherwise, a branch is made to a step 316 in order to output a signal DMA busy before the end (step 317) of the sub-routine 300 has been reached.

Otherwise, i.e. if it is determined in the third interrogation step 306 that the word count value W is not less then twenty, a branch is made to a step 308 in which the first selection signal for the second printhead Sel_2.1 is switched to the value 'one', and the address write signal AW receives the current value W of the word counter minus the value 'twenty'. In the following step 312, the pixel data are again transferred into the buffer memory.

A check is likewise made in the aforementioned fourth interrogation step 309 to determine whether the word counter exhibits the value W<20, even when it was determined previously in the interrogation step 305 that the switchover signal SO does not exhibit the status equal to one. When the word counter exhibits the value W<20, then the second selection signal for the first printhead Sel_1.2 is switched to the value 'one' in the step 310, and the address write signal AW receives the current value W of the word counter. The pixel data are again transferred into the buffer memory in the following step 312.

Otherwise, if the word counter does not exhibit the value W<20, a branch is made from the fourth interrogation step 309 to a step 311 wherein the second selection signal for the second printhead Sel_2.2 is switched to the value "one", and the address write signal AW receives the current value W of the word counter minus the value "twenty." The pixel data are again transferred into the buffer memory in the following step 312.

Figure 11:
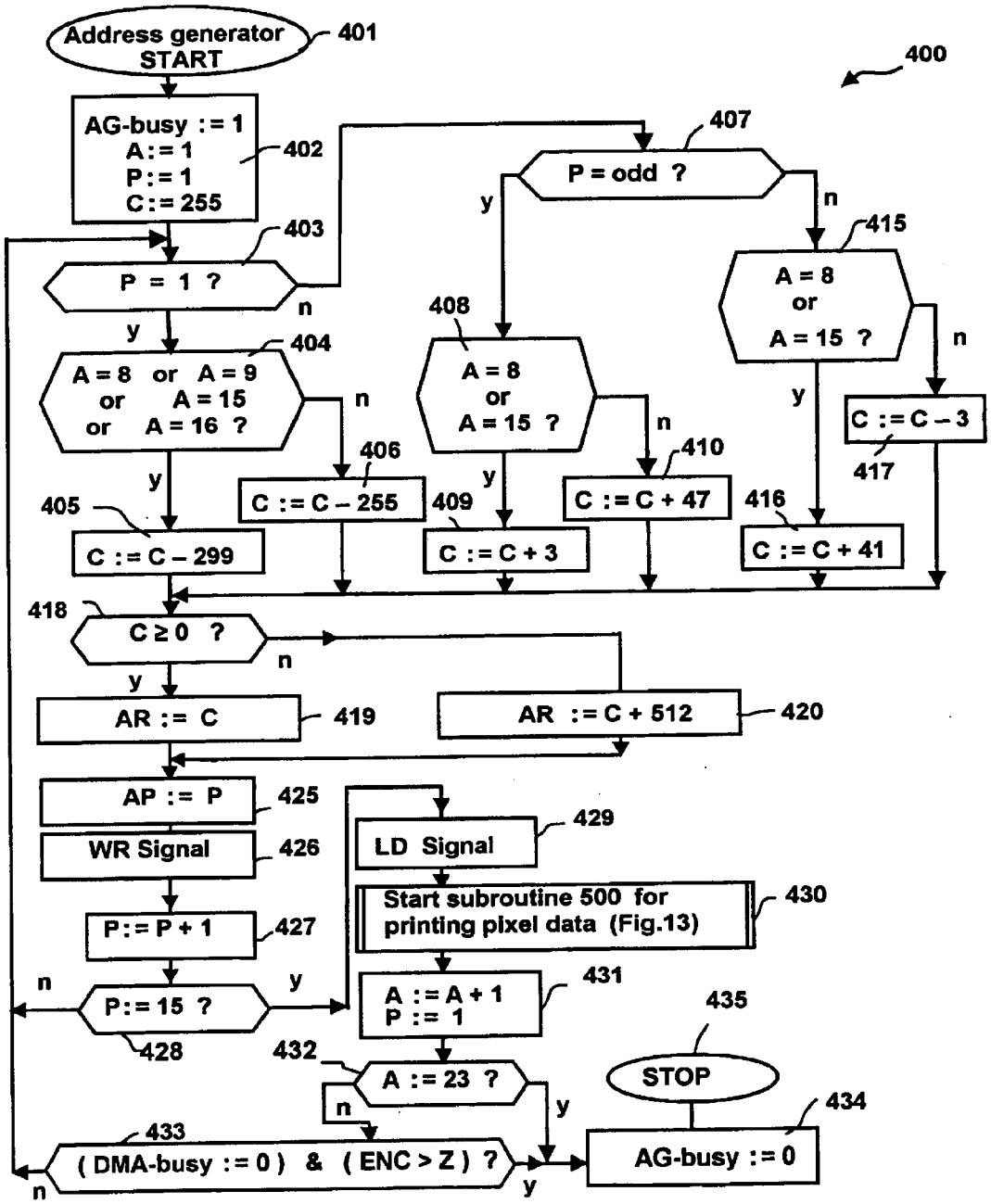
FIG. 11 is a flowchart for the address generation in accordance with the invention.

FIG. 11 shows a flowchart for the address generation. The addresses of stored binary pixel data at both printheads begin with the start address 'zero', which is generated in the following way for the address read signal AR. After the start in step 401, the start values are called in step 402, A:=1 for a counter of the address group, P:=1 for a counter of the primitive address AP and C:=255 for a counter of the address read signal AR. In the first interrogation step 403, a determination is made as to whether the numerical value P of the counter of the primitive address is equal to the value 'one' is queried. If this is the case, then the second interrogation step 404 is reached. A determination is made here as to whether the counter A has reached the value 8 or 9 or 15 or 16. If this is the case, then the step 406 is implemented, and the numerical value 255 is subtracted from the numerical value C of the counter of the address read signal AR. A determination is made in the following, third interrogation step 418 that the numerical value C of the counter of the address read signal AR is equal to/greater than the value zero, and a branch is then made to the step 419 for the output of the address read signal AR. Otherwise, a branch is made to the step 420 in order to add a numerical value 512 to the negative numerical value. The steps 425, 426 and 427 are run after the steps 419 and 420.

The numerical value for the counter of the primitive address AP is output in step 425. A write signal WR for the entry of the binary pixel datum into a collecting register is then output in step 426. The numerical value for the counter of the primitive address AP is incremented by the value one in step 427. A fourth interrogation step 428 has then been reached, and a determination is made that the numerical value P of the counter of the primitive address AP has not yet reached the limit value 15. Subsequently, a branch is made back to the first interrogation step 403.

A determination is then made in the first interrogation step 403 that the numerical value P of the counter of the primitive address is not equal to the value one and a branch is made to the fifth interrogation step 407. If the numerical value P is odd, then a branch is made to the sixth interrogation step 408 in which a check is carried out to see whether the counter of the address group has the value 8 or 15. If this is the case, then a branch is made to a step 409, and the numerical value 3 is added to the numerical value C of the counter of the address read signal AR. Otherwise, a branch is made from the sixth interrogation step 408 to a step 410, and the numerical value 47 is added to the numerical value C of the counter of the address read signal AR.

If, however, the numerical value P is even, then a branch is made from the fifth interrogation step 407 to the seventh interrogation step 415 wherein a check is carried out to see whether the counter of the address group has the value 8 or 15. If this is the case, a branch is made to a step 416, and the numerical value 41 is added to the numerical value C of the counter of the address read signal AR. Otherwise, a branch is made from the seventh interrogation step 415 to a step 417, and the numerical value 3 is subtracted from the numerical value C of the counter of the address read signal AR.

Proceeding from the steps 405, 406, 409, 410, 416 and 417, the third interrogation step 418 is reached again and a determination is made as to whether the numerical value C of the counter of the address read signal AR is greater than/equal to the value zero. Following the steps 419 and 420, the steps 425, 426 and 427 are run again until the fourth interrogation step 428 has been reached, a determination being made therein as to whether the numerical value P of the counter of the primitive address AP has already reached the limit value 15. If this is the case, then a branch is made to a step 429 and a load signal for loading the shift register is output. In order to print the pixel data out, a sub-routine 500 is started in step 430 wherein—among other things—a shift clock signal SCL is applied to the shift register in order to serially output the pixel data from the latter. In step 431, subsequently, the value of the counter of the address group is incremented by the value one. An eighth interrogation step has then been reached wherein a determination is, made as to whether the numerical value A of the counter of the address group has already reached the limit value 23. When this is not the case, then a ninth query step 433 is reached wherein a determination is made as to whether the DMA-busy signal having the value "zero" is already present and whether the numerical value ENC of the counter of the address group exceeds the third reference value Z. If, however, this is not the case, then a branch is made back to the first interrogation step 403. If, the third reference value Z is exceeded, then a signal AG-busy:=0 is output in the step 434 and the subroutine is stopped in the step 435.

In an alternative version having a corresponding evaluation circuit in the printer controller 45, only whether an abort signal is already present need be determined in the ninth query step 433.

FIG. 12 shows a table for the address generation whose address read signals AR are generated for 22 address groups by means of the aforementioned routine 400. In practice, the address generator 44 preferably generates the address values as a binary number and this is applied to the pixel data-editing units 41, 42. As is known, a binary number can be represented, for example, as a hexadecimal number or as a decimal number, as a result whereof the representation requires less space. Decimal numbers are entered in the table only for this reason and for ease of comprehension. The routine 400 first generates a primitive address P:=1 and a binary number zero as address read signal AR for a first address group A:=1. A corresponding binary number as address read signal AR for the first address group A:=1 is then successively generated up to a primitive address P:=14. The address read signal AR (address read) is thus generated for 14 binary numbers per address group. Corresponding binary numbers as address read signal AR thus are generated successively for 22 address groups. A binary pixel datum in the buffer memory is accessed by each and every address read signal AR.

The driver units 11 and 12 ignore the binary pixel data that are read given address values A=1 with P=2, A=7 with P=13, A=8 with P=1 and with P=14, A=15 with P=1 and with P=14, A=16 with P=2 as well as A=22 with P=14. The address values higher than 500 therefore need not be capable of being completely generated as binary number. For offering binary pixel data, all address values higher than 299 are in fact generated but are likewise not required when printing.

The routine 400 is implemented until all print image columns have been printed. It has already been explained in conjunction with FIGS. 9*a*, 9*b* and 10*b* that the nozzle rows of a printhead become active in alternation for printing print image columns. While one of the buffer memories is being loaded with binary pixel data by direct memory access, the other buffer memory is read out in order to transmit edited groups of binary pixel data to the driver units. The mutual repetition of the routine 400 and further subsequent steps are implemented by the printer controller 45 that, controlled by a signal e of an encoder 3, also generates the print signals Print1 or Print2.

Figure 13:
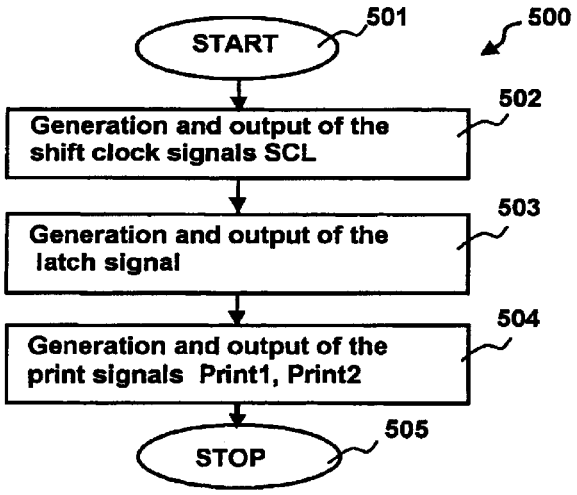
FIG. 13 is a flowchart for the output routine in accordance with the invention.

FIG. 13 shows a flowchart of the print routine 500. The print routine 500 is called as a sub-routine during the course of the sub-routine 400 in order to drive the shift registers in the print data control 41, 42 and in order to drive the driver units (pen driver boards) 11, 12. After the start in step 501, a step 502 is reached and a shift clock SCL is generated in order to move the pixel data stored in the shift register from the shift register to the respective driver unit 11 or 12 via the serial data output. Subsequently, a latch signal is generated in step 503 and is supplied to the driver units (pen driver boards) 11, 12. The print signals Print1, Print2 are then generated in step 504 and output to the driver units (pen driver boards 11, 12, and the sub-routine 500 is stopped in step 505.

A first or second number of data words that contain binary pixel data for the first or second ink jet printheads 1, 2 exists in each data string. Respective halves of each print image column is printed by the ink jet printheads 1, 2, with the first and second nozzle row of each ink jet printhead simultaneously printing the pixels with odd numbers on at least one half of a first print image column and the pixels with even numbers on at least one half of a second print image column. The first or second number of data words in the data string contains the binary pixel data for both nozzle rows of the first or second ink jet printhead 1,2. Each data word of each and every data string contains only the first or, respectively, second pixel data for printing a first or second print image column, so that one of the print image columns is present in completely printed form only after the printout of the pixel data of a further data string. From each data string, thus, that nozzle row lying at first position in the transport direction is supplied time-offset with the binary pixel data for the pixels with odd numbers of the first print image column, while the nozzle row lying at second position in the transport direction is already supplied with the binary pixel data for the pixels with even numbers of the following second print image column. Each print image column half is printed out by a first and second nozzle row of each ink jet printhead. Therefore, temporally after the printing with the second nozzle row, each print image column half is completed by a printing with the first nozzle row.

The first print image column thus is printed spaced from the second print image column in the transport direction, and the two print image columns will lie farther from one another given some printhead types and very close to one another given other types. For enhancing the print image resolution, particularly to 600 dpi, it is provided that further print image columns can occur within the spacing o: interval. The number U of data strings that are stored in the pixel memory for a print image is thus correspondingly increased. If the parameters Z and Y stored in the printer controller 45 or in the address generator 44 have higher values than cited in the aforementioned exemplary embodiment, the abort of ongoing print cycles ensues only after an even larger number of successive encoder pulses with reduced time spacing have occurred. An offset that is greater than shown then must be accepted. Pixels that belong to one printing column would then also be printed distributed over a larger number of printing columns.

The blocks shown in the block circuit diagrams of FIGS. 2, 3, 4, 8 and 9 are implemented in a positive digital logic in the described embodiment. Since the type of logic can be arbitrarily selected, there are numerous suitable modifications of the embodiment. The hardware realization is possible in a well-known way, for example with an ASIC or with an FPGA (field programmable gate array).

Although modifications and changes may be suggested by those skilled in the art, it is the intention of the inventor to embody within the patent warranted hereon all changes and modifications as reasonably and properly come within the scope of his contribution to the art.

I claim as my invention:

1. A method for reducing printer errors while printing on a moving medium comprising the steps of:

transporting a print medium past a printhead and generating encoder pulses representing relative motion between said printhead and said print medium;

generating a counter count by incrementation and decrementation to identify an occurrence of a reduced time spacing between successive encoder pulses;

from a memory wherein binary pixel data are stored in a plurality of data strings, implementing a direct memory access in the time segment with direct memory access DMA cycles for one of said data strings; and implementing a print cycle for said one of said data strings to print data with said printhead, represented by said one of said data strings, on said print medium and, during said print cycle, implementing a further direct memory access in another time segment with DMA cycles from said memory for a next of said data strings to be printed and, following implementation of said further direct memory access for said next of said data strings and dependent on said time spacing for a plurality of successive encoder pulses, completely executing said print cycle as long as an average value of an encoder period of said plurality of successive encoder pulses does not downwardly transgress a predetermined duration of said print cycle, and aborting said print cycle if said counter count indicates said reduced time spacing.

2. A method as claimed in claim 1 comprising, dependent on the reduced time spacing from a number of encoder pulses, the spacing of the print cycles from one another is reduced until the following print cycle for printing out binary pixel data of a following data string follows immediately after a completely executed print cycle for printing out binary pixel data of a previous data string, whereby the reduction ensues to the extent that the encoder pulses lead the print cycles.

3. A method as claimed in claim 1 comprising, if said time spacing is not reduced, setting a duration for each print cycle to a time duration between two positive encoder pulse edges to space successive print cycles from each other and comprising identifying said reduced time spacing from said counter count by incrementing said counter count at each encoder pulse and decrementing said counter count at a beginning of each print cycle, and aborting a current print cycle if said counter count exceeds a predetermined reference value under the conduction that all direct memory access cycles for a next print cycle have ended.

4. A printing arrangement comprising:

a printhead;

a transport arrangement for transporting a print medium past said printhead;

an encoder that generates encoder pulses dependent on a relative movement between said print medium and said printhead;

a pixel memory containing pixel data representing pixels to be printed on said print medium by said printhead;

a print data controller for controlling transfer of said pixel data from said pixel memory to said printhead for printing in successive print cycles on said print medium by said printhead;

said print data controller comprising an evaluation unit and logic for reducing printer errors in printing by said printhead on said print medium, said logic being supplied with said encoder pulses and containing a resettable encoder clock counter having a count value that is incremented by respective leading edges of said encoder pulses and that is decremented with each start of each of said print cycles, said count value being supplied by said logic to said evaluation unit and said evaluation unit determining whether said count value exceeds a reference value, and causing a current print cycle to be aborted if said reference value is upwardly transgressed under the condition that all direct memory access cycles to said pixel memory for preparing a next print cycle have ended.

5. An arrangement as claimed in claim 4 wherein said print data controller comprises a direct memory access DMA controller, an address generator, a printer controller and said address generator comprising said evaluation unit, and wherein said evaluation unit contains a register for storing said reference value and a comparator connected to said register and supplied with said count value from said logic for determining whether said reference value has been upwardly transgressed.

6. An arrangement as claimed in claim 4 wherein said resettable encoder clock counter has a counting range with an upper limit, and wherein said logic includes a first digital comparator that prevents decrementing of said count value if said count value reaches zero, and a second digital comparator that prevents incrementing of said count value if said count value reaches said upper limit and said encoder clock counter has an output connected to said evaluation unit for supplying said count value to said evaluation unit in said address generator.

7. An arrangement as claimed in claim 6 wherein said encoder clock counter comprises a decrementing input, an incrementing input and a reset input, and a plurality of outputs at which said count value is present as a multiple bit binary value, and wherein said outputs of said encoder clock counter are connected to first inputs of said first digital comparator and wherein said first digital comparator has a second input with a value of zero, and wherein said outputs of said encoder clock counter are supplied to first inputs of said second digital comparator, said second digital comparator having a second input connected to said register, and wherein said logic further comprises a first AND gate having a first input supplied with an output from said first digital comparator and a second input supplied with a decrement signal and an output connected to said decrementing input of said encoder clock counter, and a second AND gate having a first input connected to an output of said second digital comparator and a second input which receives said encoder pulses and an output connected to said incrementing input of said encoder clock counter.

8. An arrangement as claimed in claim 7 wherein said encoder clock counter is an n-bit counter, wherein n is said plurality of outputs.

9. An arrangement as claimed in claim 7 wherein said print data controller is supplied with said encoder pulses, a reset signal for said encoder clock counter, said decrement signal and said upper limit.

10. An arrangement as claimed in claim 4 wherein said print data controller is an application-specific integrated circuit.

11. An arrangement as claimed in claim 4 wherein said print data controller is formed by programmable logic.

12. An arrangement as claimed in claim 4 wherein said print data controller comprises a DMA controller, an address generator, a printer controller and said printer controller comprising said evaluation unit, and wherein said evaluation unit contains a register for storing said reference value and a comparator connected to said register and supplied with said count value from said logic for determining whether said reference value has been upwardly transgressed.

* * * * *